US012611073B2

(12) United States Patent
Danis et al.

(10) Patent No.: US 12,611,073 B2
(45) **Date of Patent: *Apr. 28, 2026**

(54) DISPENSING ASSEMBLY FOR PAPER PRODUCTS

(71) Applicant: Christopher J. Danis, Centerville, OH (US)

(72) Inventors: Christopher J. Danis, Centerville, OH (US); Christopher L. Brandon, Dublin, OH (US); Matthew D. Schrader, Baltimore, OH (US); Keevyn B. Winterwood, Columbus, OH (US); Michael J. Krull, Hilliard, OH (US); Kenneth A. George, Avon, OH (US)

(73) Assignee: Christopher J. Danis, Centerville, OH (US)

( * ) Notice: Subject to any disclaimer, the term of this patent is extended or adjusted under 35 U.S.C. 154(b) by 105 days.

This patent is subject to a terminal disclaimer.

(21) Appl. No.: 18/806,242

(22) Filed: Aug. 15, 2024

(65) Prior Publication Data

US 2024/0398178 A1 Dec. 5, 2024

Related U.S. Application Data

(63) Continuation of application No. 18/241,401, filed on Sep. 1, 2023, now Pat. No. 12,082,751, which is a continuation of application No. 17/357,960, filed on Jun. 24, 2021, now Pat. No. 11,771,271, which is a continuation-in-part of application No. 16/911,362, filed on Jun. 24, 2020, now Pat. No. 11,051,663, which is a continuation-in-part of application No. 16/226,762, filed on Dec. 20, 2018, now Pat. No. 10,806,307.

(51) Int. Cl.

| | |
|---|---|
| ***A47K 10/36*** | (2006.01) |
| ***A47K 10/32*** | (2006.01) |
| ***A47K 10/38*** | (2006.01) |

(52) U.S. Cl.

CPC ..... *A47K 10/3687* (2013.01); *A47K 10/38* (2013.01); *A47K 2010/3233* (2013.01); *A47K 2010/3266* (2013.01); *A47K 2010/3681* (2013.01)

(58) Field of Classification Search

None

See application file for complete search history.

(56) References Cited

U.S. PATENT DOCUMENTS

| | | | | |
|---|---|---|---|---|
| 10,806,307 | B2 * | 10/2020 | Danis | A47K 10/3637 |
| 11,051,663 | B1 * | 7/2021 | Danis | A47K 10/3612 |
| 11,771,271 | B1 * | 10/2023 | Danis | A47K 10/3687 242/594 |
| 12,082,751 | B2 * | 9/2024 | Danis | A47K 10/3687 |

* cited by examiner

*Primary Examiner* — William A. Rivera

(74) *Attorney, Agent, or Firm* — FBT Gibbons LLP; Alexander J. Johnson; Vance V. VanDrake, III

(57) ABSTRACT

A dispensing assembly is disclosed herein. The dispensing assembly includes a housing comprising a plurality of side panels that together define a compartment; a self-contained cartridge for dispensing a paper product, the self-contained cartridge being removably received in the compartment of the housing; and an actuation subassembly being disposed in the housing, the actuation subassembly configured to advance the paper product disposed in the self-contained cartridge.

20 Claims, 20 Drawing Sheets

Section A-A

Section B-B

Section C-C

Section D-D

DISPENSING ASSEMBLY FOR PAPER PRODUCTS

CROSS-REFERENCE TO RELATED APPLICATIONS

This application is a continuation of U.S. patent application Ser. No. 18/241,401, filed Sep. 1, 2023, which is a continuation of U.S. patent application Ser. No. 17/357,960, filed on Jun. 24, 2021, which was granted as U.S. Pat. No. 11,771,271 on Oct. 3, 2023, which is a continuation-in-part of U.S. patent application Ser. No. 16/911,362, filed Jun. 24, 2020, which was granted as U.S. Pat. No. 11,051,663 on Jul. 6, 2021, which is continuation-in-part of U.S. patent application Ser. No. 16/226,762, filed Dec. 20, 2018, which was granted as U.S. Pat. No. 10,806,307 on Oct. 20, 2020, the disclosure of these hereby being incorporated by reference as if set forth its entirety herein.

FIELD OF INVENTION

The present invention relates to a dispensing assembly for paper products and, more specifically, to a housing and a cartridge for dispensing pre-wetted paper products.

BACKGROUND

Many conventional combination dispensers for wet and dry paper products (e.g., toilet paper) occupy excessive amounts of space and do not provide convenient access to both the wet and dry paper products. In addition, current dispensers often do not allow for easy replacement or replenishment of the wet paper products by the consumer and fail to provide a barrier to loss of moisture from the wet paper products. Furthermore, some dispensers require installation of special-purpose holders, and dispensers that attach to existing wall-mounted holders may still require modification of the holder, the wall, or other adjacent structure to accommodate the dispenser. Many of these conventional dispensers are not recyclable or may contain one or more components that are not recyclable.

BRIEF SUMMARY OF EMBODIMENTS OF THE INVENTION

Accordingly, the present disclosure is directed to a dispensing assembly for paper products that substantially obviates one or more problems resulting from the limitations and deficiencies of the related art.

In accordance with one or more embodiments of the present disclosure, there is provided a dispensing assembly that includes a housing comprising a plurality of side panels that together define a compartment: a self-contained cartridge for dispensing a paper product, the self-contained cartridge being removably received in the compartment of the housing; and an actuation subassembly being disposed in the housing, the actuation subassembly configured to advance the paper product disposed in the self-contained cartridge.

In a further embodiment of the present disclosure, the housing further comprises an elongate body portion with the plurality of side panels and a pair of end caps for attaching to opposed ends of the elongate body portion.

In yet a further embodiment, the dispensing assembly further comprises a hanger component attached to the housing, the hanger component comprising a pair of arms that suspend the housing below a spindle.

In still a further embodiment, the self-contained cartridge further comprises one or more ribs and one or more flat surfaces along a dispensing edge of the paper product for supporting the paper product during dispensing.

In yet a further embodiment, the self-contained cartridge is configured to be inserted into an end of the housing.

In still a further embodiment, the self-contained cartridge further comprises a top portion and a bottom portion, the top portion comprising an active roller and bottom portion comprising a passive roller; and, when the top portion is closed against the bottom portion, the active and passive rollers are adjacent to one another, and the paper product is compressed between the active and passive rollers.

In yet a further embodiment, the actuation subassembly comprises a drive gear and a drive motor, the drive gear being operatively coupled to the drive motor and to the active roller via a drive shaft, and when a button is depressed on the housing, the drive gear and the active roller rotate a predefined rotational distance to advance the paper product.

In still a further embodiment, the drive gear is operatively coupled to the drive motor via a worm gear.

In yet a further embodiment, the actuation subassembly comprises a gear and a spring, the gear being coupled to a lever and to the active roller via a drive shaft. When the lever is depressed from a first position, the gear and the active roller rotate a predefined rotational distance to advance the paper product; and, when the lever is released, the spring biases the lever back to the first position.

In still a further embodiment, the dispensing assembly further comprises a sensor device configured to detect perforations or a line of weakness in the paper product so as to determine when the paper product has been dispensed.

In yet a further embodiment, the sensor device is further configured to determine the amount of the paper product that has been dispensed so as to determine when a roll of the paper product in the self-contained cartridge needs to be replaced.

In still a further embodiment, the dispensing assembly is configured to be attached to a wall-mounted toilet tissue holder, the dispensing assembly further comprising a hanger component with a pair of arms that suspend the housing below the wall-mounted toilet tissue holder, and each of the pair of arms of the hanger component further comprises an aperture extending therethrough for receiving a spindle that supports a roll of toilet tissue.

In yet a further embodiment, the paper product comprises flushable wet wipes that are configured to dissolve in water.

In accordance with one or more other embodiments of the present disclosure, there is provided a dispensing assembly that includes a housing comprising a plurality of side panels that together define a compartment; and a self-contained cartridge for dispensing a paper product, the self-contained cartridge being removably received in the compartment of the housing. The self-contained cartridge comprises a top portion with an active roller and a bottom portion with a passive roller, and the paper product is dispensed from a slot formed in the self-contained cartridge. When the top portion is closed against the bottom portion, the active and passive rollers are adjacent to one another, and the paper product is compressed between the active and passive rollers.

In a further embodiment of the present disclosure, the housing further comprises an elongate body portion with the plurality of side panels and a pair of end caps for attaching to opposed ends of the elongate body portion.

In yet a further embodiment, the dispensing assembly further comprises a hanger component attached to the housing, the hanger component comprising a pair of arms that suspend the housing below a spindle.

In still a further embodiment, the dispensing assembly further comprising an actuation subassembly being disposed in the housing, the actuation subassembly configured to advance the paper product disposed in the self-contained cartridge. The actuation subassembly comprises a drive gear and a drive motor, the drive gear being operatively coupled to the drive motor and to the active roller via a drive shaft, and when a button is depressed on the housing, the drive gear and the active roller rotate a predefined rotational distance to advance the paper product.

In yet a further embodiment, the drive gear is operatively coupled to the drive motor via a worm gear.

In still a further embodiment, the actuation subassembly comprises a gear and a spring, the gear being coupled to a lever and to the active roller via a drive shaft. When the lever is depressed from a first position, the gear and the active roller rotate a predefined rotational distance to advance the paper product; and, when the lever is released, the spring biases the lever back to the first position.

In yet a further embodiment, the dispensing assembly further comprises a sensor device configured to detect perforations or a line of weakness in the paper product so as to determine when the paper product has been dispensed.

It is to be understood that the foregoing general description and the following detailed description of the present disclosure are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

Throughout the figures, the same parts are always denoted using the same reference characters so that, as a general rule, they will only be described once.

DETAILED DESCRIPTION OF EMBODIMENTS OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
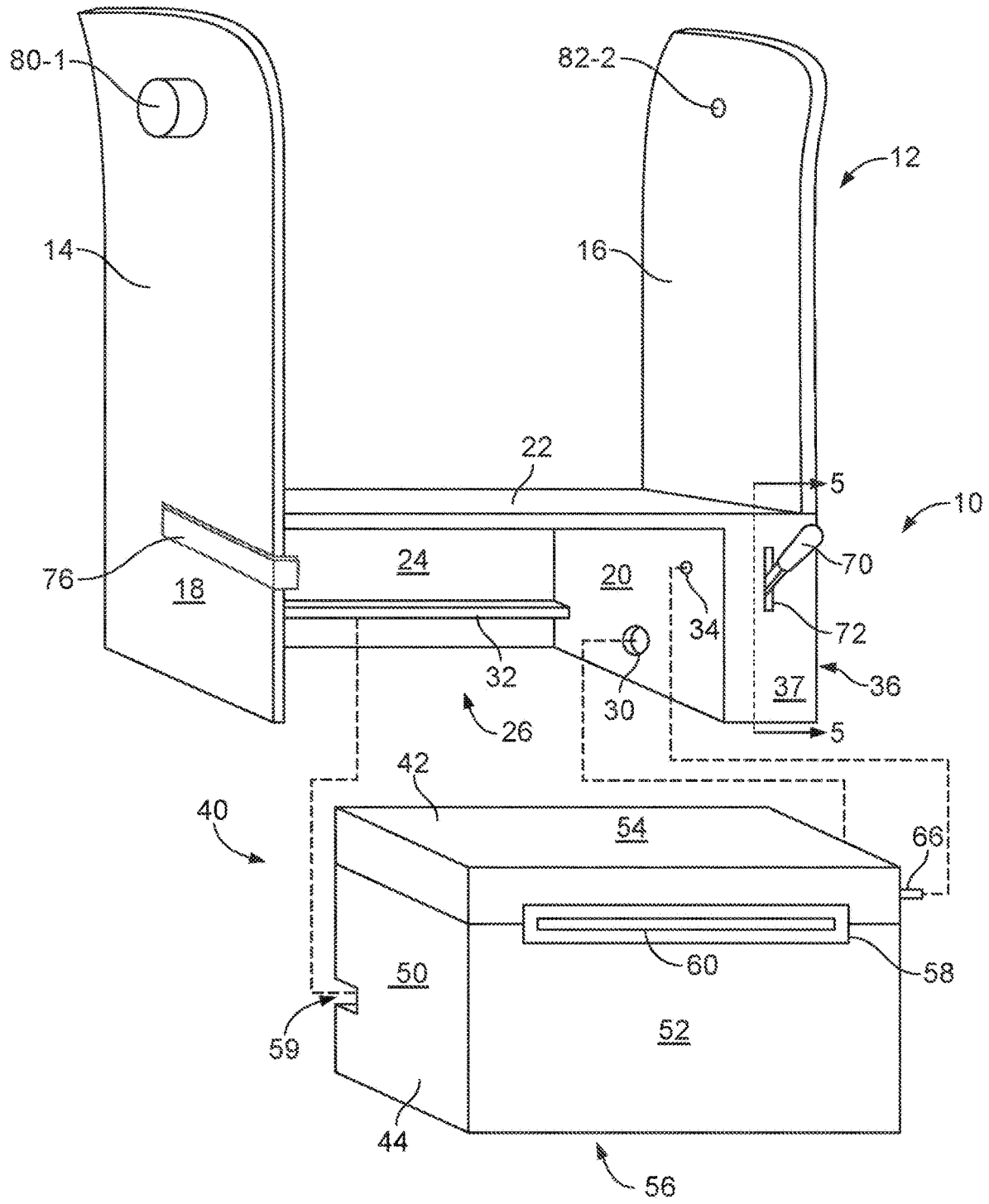
FIG. 1 is an exploded view of a first embodiment of a dispensing assembly comprising a housing and a cartridge in accordance with principles of the present disclosure.
Figure 3:
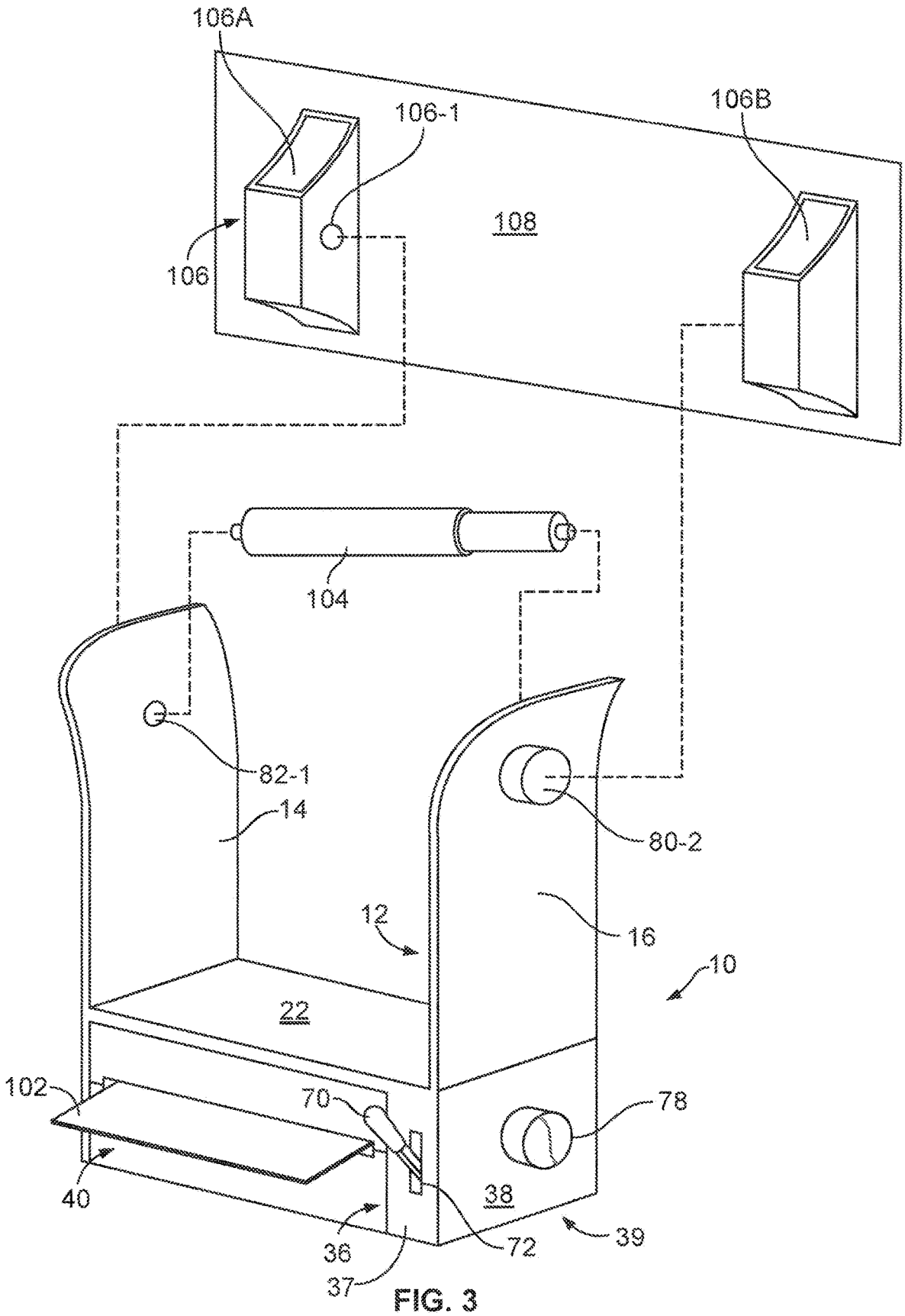
FIG. 3 is an exploded view of the dispensing assembly of FIG. 1 for attachment to a wall-mounted toilet tissue holder.

With reference to FIGS. 1 and 3, a dispensing assembly 10 in accordance with a first embodiment of the present disclosure is depicted. The dispensing assembly 10 comprises a housing 12 and a cartridge 40. The housing 12 and the cartridge 40 may each comprise one or more polymeric materials and may consist at least partially of recycled and/or recyclable materials. The housing 12 may comprise a pair of arms 14, 16, a first side panel 18, a second side panel 20, a top panel 22, and a back panel 24. The top panel 22 and back panel 24 extend between and connect the side panels 18, 20. The side, top, and back panels 18, 20, 22, 24 together define a compartment 26 into which the cartridge 40 is removably received, as described herein.

Figure 6:
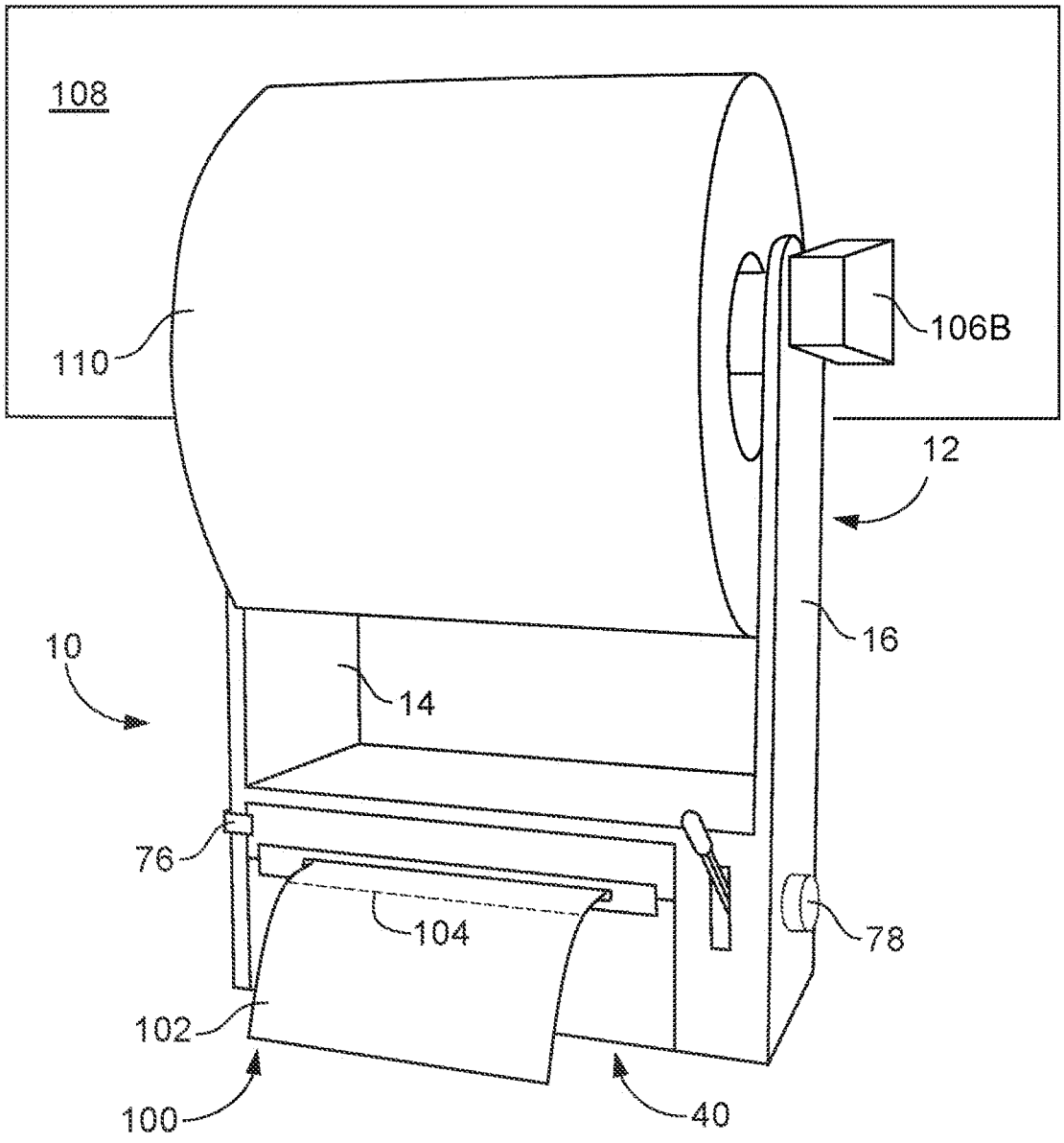
FIG. 6 is a front perspective view of a fully assembled dispensing assembly in accordance with principles of the present disclosure.

The pair of arms 14, 16 suspend the housing 12 below a fixed substrate 106, as shown in FIGS. 3 and 6. The fixed substrate 106 may comprise a variety of styles and may support, for example, a dry paper product such as toilet tissue 110. The fixed substrate 106 may comprise, for example, a wall-mounted toilet tissue holder with a first post 106A and a second post 106B that are mounted to a wall 108. The posts 106A, 106B comprise respective apertures 106-1, 106-2 that would normally receive a conventional spindle 104, which may be a spring-loaded spindle as is known in the art. In some examples as shown in FIGS. 1, 3, and 6, the housing 12 may comprise a structure in which upper portions of each arm 14, 16 comprise a respective protrusion 80-1, 80-2 extending outward from an outer surface of the arm 14, 16. The arms 14, 16 may be moved toward each other and placed between the posts 106A, 106B such that the protrusions 80-1, 80-2 are received by and mounted in the apertures 106-1, 106-2 formed in the posts 106A, 106B of the wall-mounted toilet tissue holder. Following installation, the housing 12 hangs below the fixed substrate 106, as best seen in FIG. 6. The upper portions of each arm 14, 16 comprise indents 82-1, 82-2 extending inward from an inner surface of the respective arm 14, 16. The toilet tissue roll 110 may be placed on the spindle, opposing ends of the spindle 104 may be pushed toward each other, and the spindle 104 may be placed between the arms 14, 16 such that the indents 82-1, 82-2 receive the opposing ends of the spindle 104, with the spring (not shown) in the spindle 104 biasing the opposing ends of the spindle 104 toward a respective one of the arms 14, 16. Following installation of the spindle 104 in the indents 82-1, 82-2, the toilet tissue roll 110 is supported above the compartment 26 that receives the cartridge 40. The structure of the housing 12 shown in FIGS. 1, 3, and 6 allows installation and removal of the spindle 104 and the toilet tissue roll 110 without the need to remove the housing 12 from the fixed substrate 106. The upper portions of the arms 14, 16 may be slightly curved away from each other, as shown in FIGS. 1 and 3, or may be substantially straight or planar, as shown in FIG. 6.

Figure 4:
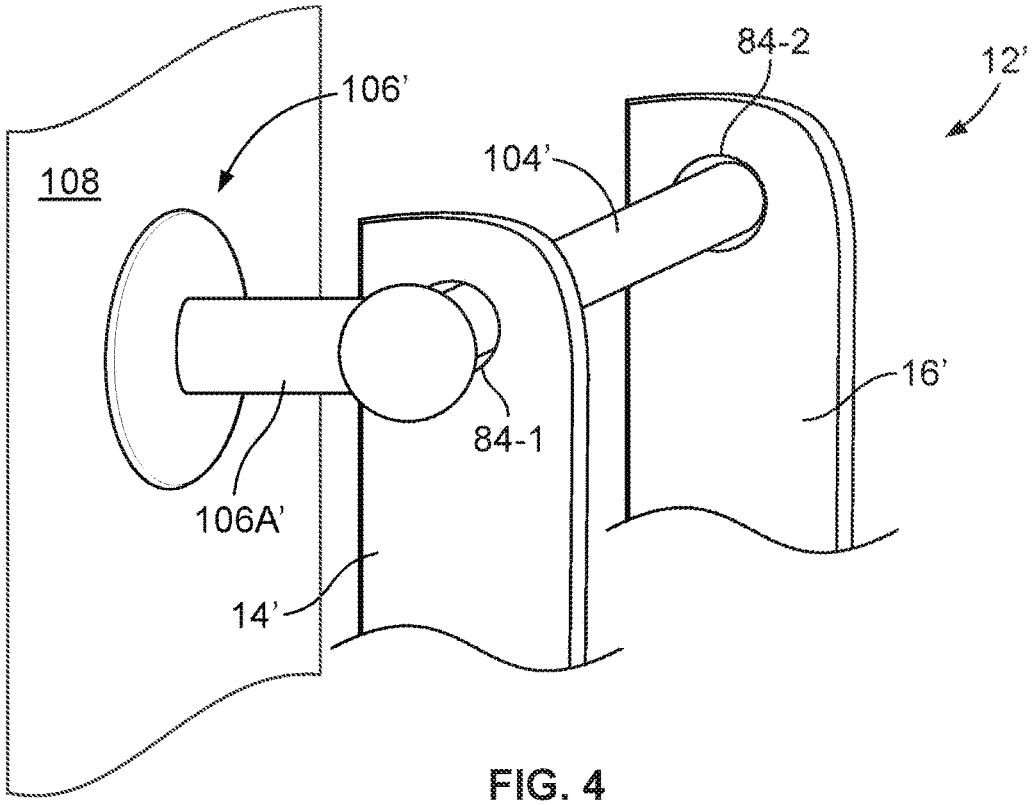
FIG. 4 is a detailed perspective view of a portion of a housing of another dispensing assembly in accordance with principles of the present disclosure.

In other examples as shown in FIG. 4, the fixed substrate 106' may comprise a different type or style of wall-mounted holder, and the housing 12' may comprise a different structure adapted to be attached to the fixed substrate 106'. In some configurations, the fixed substrate 106' may comprise a hinged holder with a bar 104' that is coupled to and pivots about one post 106A'. The pivoting bar 104' may rest on a second post (not shown). In other instances, the fixed substrate 106' may comprise a single post 106A', and the bar 104' may be fixed to (i.e., not movable relative to) the post 106A'. In all instances, the bar 104' may serve as a spindle to support a dry paper product or other object, such as a towel (not shown). The housing 12' of FIG. 4 may comprise first and second arms 14', 16' with a respective aperture 84-1, 84-2 extending through a thickness of each arm 14', 16'. The bar 104' may be inserted through the apertures 84-1, 84-2 formed in the arms 14', 16' to suspend the housing 12' below the fixed substrate 106'. The housing 12' may otherwise comprise the same structure as the housing 12 depicted in FIGS. 1, 3, and 6. In general, at least one of the arms, e.g., the second arm 16', of the housing 12' in FIG. 4 would need to be removed from the bar 104' to install or replace a conventional toilet tissue roll supported on the bar 104'. It is understood that the housing 12' in FIG. 4 could also be used with the fixed substrate 106 depicted in FIG. 3. It is also understood that the housing 12, 12' described herein could be used with any suitable fixed substrate, such as a recessed toilet tissue holder. In further examples, the housing 12, 12' may be used with a freestanding structure (not shown), such as a freestanding toilet tissue holder.

In all examples, when installed on the fixed substrate 106, 106', the arms 14, 16 and 14', 16' suspend the housing 12, 12' below the fixed substrate 106, 106' and below the toilet tissue roll 110, as shown in FIGS. 3, 4, and 6. The housing 12 may extend outward from the wall 108 no more than the posts 106A, 106B and/or the toilet tissue roll 110, and a greatest width of the housing 12 in a lateral direction may be no more than a lateral spacing between the posts 106A, 106B.

With reference to FIGS. 1 and 2A-2C, the cartridge 40 comprises a lid 42 and a main body 44 with a first side 46, a second side 48, a third side 50, a fourth side 52, a top 54, and a bottom 56. The lid 42 is coupled to the main body 44 by a hinge 58 extending longitudinally along at least a portion of the fourth side 52, as best seen in FIG. 1. The hinge 58 may comprise a strip of thin, flexible material adhered to the cartridge 40 and spanning between the lid 42 and the main body 44. The cartridge 40 may be opened by moving the lid 42 in a direction indicated by arrow C in FIG. 2C, in which the lid 42 pivots along the hinge 58 to allow access to an interior space (not labeled) of the cartridge 40.

Figure 2A:
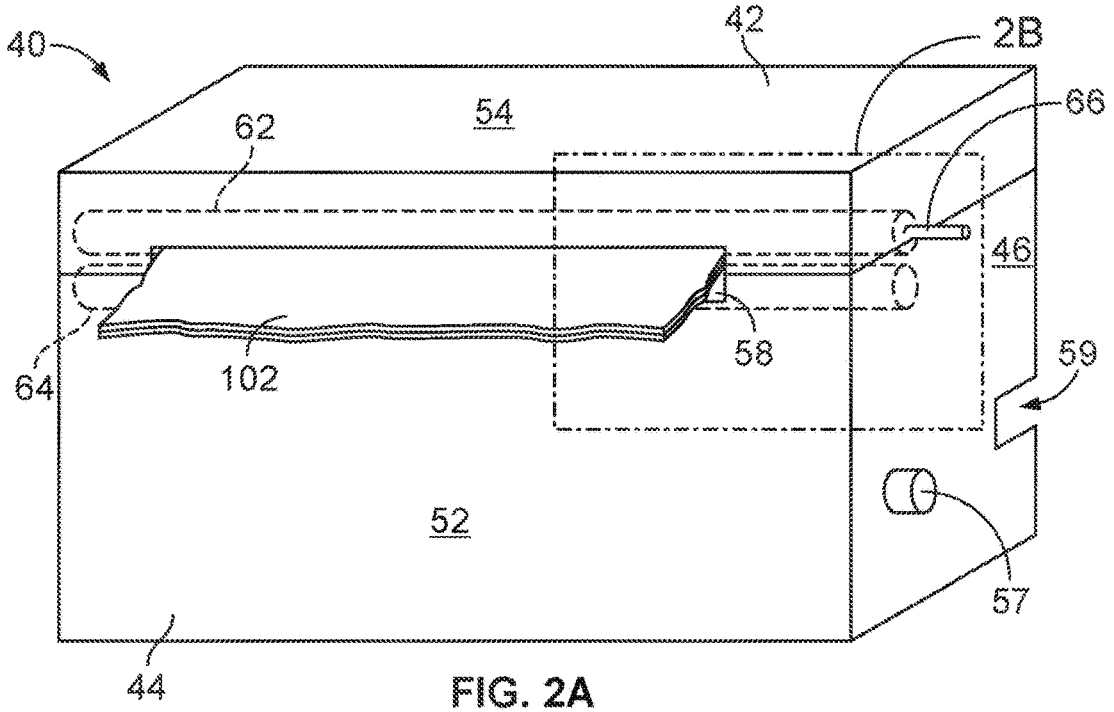
FIG. 2A is a front perspective view of the cartridge of FIG. 1.
Figure 2B:
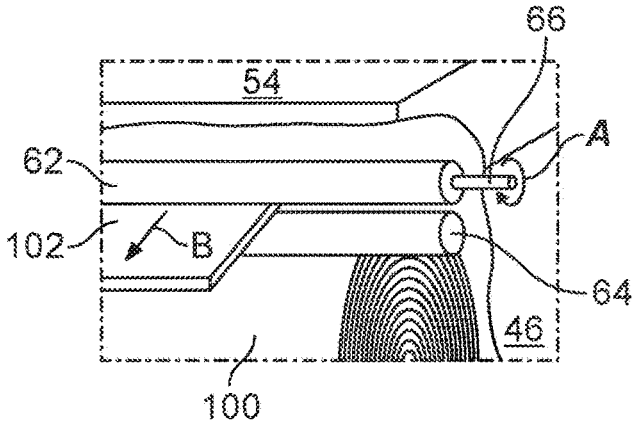
FIG. 2B is a detailed view of a portion of the cartridge of FIG. 2A.
Figure 2C:
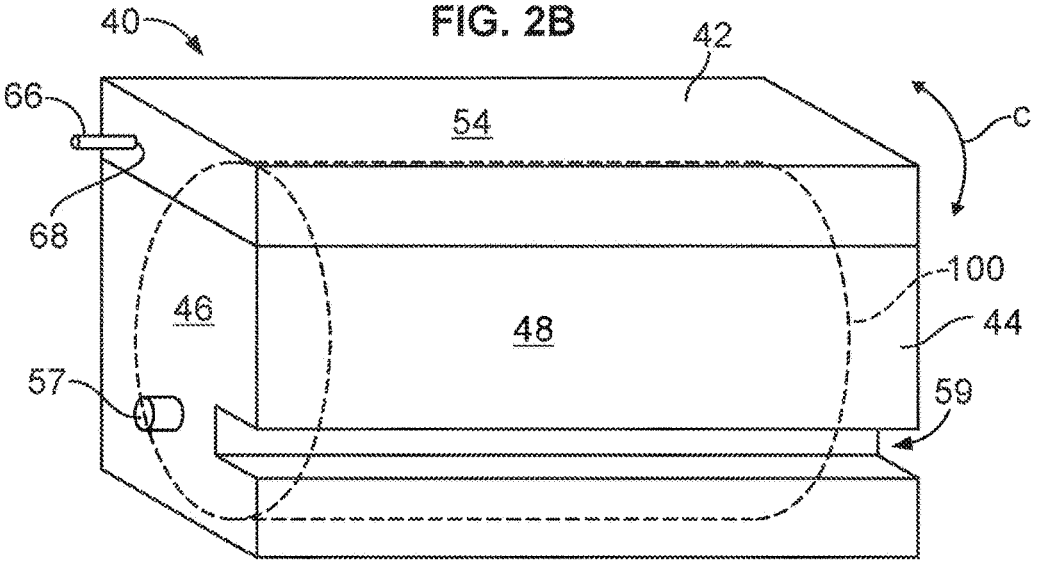
FIG. 2C is a back perspective view of the cartridge of FIG. 2A.

The cartridge 40 may be for dispensing a paper product 100, as shown in FIG. 2C. The cartridge 40 may accommodate a variety of wet paper products and may be refillable. The paper product 100 may comprise, for example, a rolled, continuous sheet of a pre-wetted paper product such as a personal wipe (commonly referred to as a wet wipe or moist towelette), which may be disposable and/or flushable (i.e., may be flushed down a toilet for disposal with other solid waste). As shown in FIG. 6, the paper product 100 may comprise perforations 104 that define individual sheets 102. In other examples (not shown), the paper product 100 may comprise a stacked wet paper product comprising a plurality of individual, folded sheets, in which the individual sheets are interleaved with and overlap adjacent sheets as shown in U.S. Pat. No. 6,213,344, the disclosure of which is hereby incorporated by reference in its entirety.

The cartridge 40 comprises an active roller 62 and a passive roller 64, as shown in FIGS. 2A and 2B. The active roller 62 is rotatably coupled to and contained in the lid 42. The active roller 62 comprises a shaft 66 that extends from one end of the active roller 62 through an aperture 68 formed in the lid 42, such that the shaft 66 protrudes from the cartridge 40. The passive roller 64 is rotatably coupled to and contained in the main body 44 of the cartridge 40 adjacent to the active roller 62.

With continued reference to FIGS. 1 and 2A-2C, to install the paper product 100 in the cartridge 40, the lid 42 is opened in the direction indicated by the arrow C and the paper product 100 is placed into the cartridge 40. A first sheet 102 of the rolled or stacked paper product 100 is placed over the passive roller 64 in the main body 44 and inserted into a slot 60 formed in the hinge 58 such that the sheet 102 extends through the slot 60 between the lid 42 and main body 44 and extends outward from the fourth side 52 of the cartridge 40. When the lid 42 is closed, the active roller 62 contacts the sheet 102 and compresses the paper product 100 between the active and passive rollers 62, 64. The active and passive rollers 62, 64 may be formed from and/or coated or covered with a non-slip or gripping material. One or both of the active roller 62 or the passive roller 64 may also comprise a spring or other structure (not shown) that biases the rollers 62, 64 toward each other.

The active and passive rollers 62, 64 together form a seal across the slot 60 through which the paper product 100 is dispensed. This seal may be partially watertight, which helps to reduce loss of moisture from the paper product 100. In addition, the cartridge 40 fully encloses the paper product 100 on all sides, which further helps to reduce loss of moisture from the paper product 100. Compression of the paper product 100 between the rollers 62, 64 also helps to prevent retraction or withdrawal of the paper product 100 back through the slot 60 and into the cartridge 40. While the hinge 58 may extend along all or part of the fourth side 52 of the cartridge, the slot 60 generally does not extend along an entirety of the fourth side 52, such that the active roller 62 directly contacts at least a section of the passive roller 64, e.g., at opposing ends of the rollers 62, 64 as shown in FIG. 2A. As described in more detail herein, the active and passive rollers 62, 64 cooperate to dispense sheets 102 of the paper product 100 via the slot 60 in a direction indicated by arrow B.

As shown in FIG. 1, the compartment 26 is enclosed on only four sides (e.g., by the side, top, and back panels 18, 20, 22, 24 of the housing 12), with a bottom and a front (not separately labeled) of the compartment 26 being open. One or more portions of the cartridge 40 may engage one or more structures formed on an inner surface (not separately labeled) of the compartment 26. The cartridge 40 may be aligned in the compartment 26 and secured to the housing 12 by engagement between the cartridge 40 and the housing 12. For example, an alignment indent 30 formed in an inner surface of the second side panel 20 of the housing 12 may receive a corresponding alignment protrusion 57 extending outward from an outer surface (not separately labeled) of the first side 46 of the cartridge 40, as seen in FIGS. 1 and 2A. Alternatively or in addition, the back panel 24 of the housing 12 may comprise an alignment ridge 32 extending along at least a section and extending outward from an inner surface of the back panel 24. The alignment ridge 32 may be received in a corresponding alignment recess 59 extending inward from an outer surface of the second side 48 of the cartridge 40, as seen in FIGS. 1 and 2C. The alignment recess 59 may extend longitudinally along at least a section of the second side 48 of the cartridge 40. The housing 12 may further comprise a clip 76 that is coupled to the first side panel IS. The clip 76 may comprise an "L" shape, with a first portion of the clip 76 extending parallel to the first side panel 18 toward the front of the compartment 26 and a second portion extending over the front of the compartment perpendicular to the first portion and to the first side panel 18. The clip 76 may comprise, for example, a thin strip of flexible material that may be substantially similar to the material of the housing 12. The clip 76 may further help to retain the cartridge 40 in the compartment 26, as described below. Alternatively, or in addition to these structures, the third side 50 and/or top 54 of the cartridge 40 may comprise one or more structures (not shown) that engage corresponding structures (not shown) formed in an inner surface of the first side panel 18 and/or top panel 22 of the housing 12. It is understood that the one or more portions of the cartridge 40 and the corresponding structure(s) formed on the inner surface of the compartment 26 may comprise any suitable shape and/or dimension.

With reference to FIG. 1, the cartridge 40 may be installed into the housing 12 by grasping and pulling the second portion of the clip 76 outwardly from the first side panel 18 and inserting the first side 46 of the cartridge 40 into the compartment 26 at a slight angle such that the alignment protrusion 57 is partially received in the alignment indent 30 of the second side panel 20. The shaft 66 is received in an opening 34 formed in the second side panel 20, as described in more detail herein. The cartridge 40 may then be pushed toward the back panel 24 and straightened, such that the alignment ridge 32 is received in the alignment recess 59. The cartridge 40 may be received in the compartment 26 such that the fourth side 52 of the cartridge 40 is flush with adjacent sections of the side and top panels 18, 20, 22 of the housing 12, as shown in FIGS. 3 and 6. The clip 76 may then be released, and the second portion of the clip 76 may extend over the fourth side 52 of the cartridge 40 to hold the cartridge 40 in place and prevent the cartridge 40 from falling out of the front of the compartment 26, as shown in FIG. 6. The cartridge 40 may be removed from the housing 12 by pulling the second portion of the clip 76 outwardly from the first side panel 18 and reversing the remaining steps.

When installed, the cartridge 40 is held securely against the inner surfaces of one or more of the side, top, and back panels 18, 20, 22, 24 of the housing 12 by engagement between the clip 76 and the fourth side 52 of the cartridge 40 and by engagement between respective ones of the alignment indent and ridge 30, 32 of the housing 12 and the alignment protrusion and recess 57, 59 of the cartridge 40. Engagement between these portions of the housing 12 and the cartridge 40 aligns the cartridge 40 in the compartment 26 and prevents unwanted detachment of the cartridge 40 from the housing 12. In particular, engagement between the housing 12 and the cartridge 40 prevents the cartridge from falling through the open bottom of the compartment 26 and from sliding out of the open front of the compartment 26. Installation of the cartridge 40 into the housing 12 also helps to securely close the lid 42 of the cartridge 40 against the main body 44 to maintain compression of the paper product 100 between the active and passive rollers 62, 64, as shown in FIGS. 2A and 2B.

With reference to FIGS. 1, 3 and 4, a portion of the housing 12 adjacent to the compartment 26 may further comprise a gear compartment 36 that encloses a gear assembly 86. The gear compartment 36 may be defined on three sides by the second side panel 20, the top panel 22, and the back panel 24 of the housing 12 and on the other three sides by a front panel 37, a side panel 38, and a bottom panel 39. A lever 70 extends through a slot 72 formed in the front panel 37. The lever 70 is coupled to the gear assembly 86 and is used in cooperation with the rollers 62, 64 of the cartridge 40 to dispense sheets 102 of the paper product 100 from the cartridge 40, as described herein in more detail.

Figure 5:
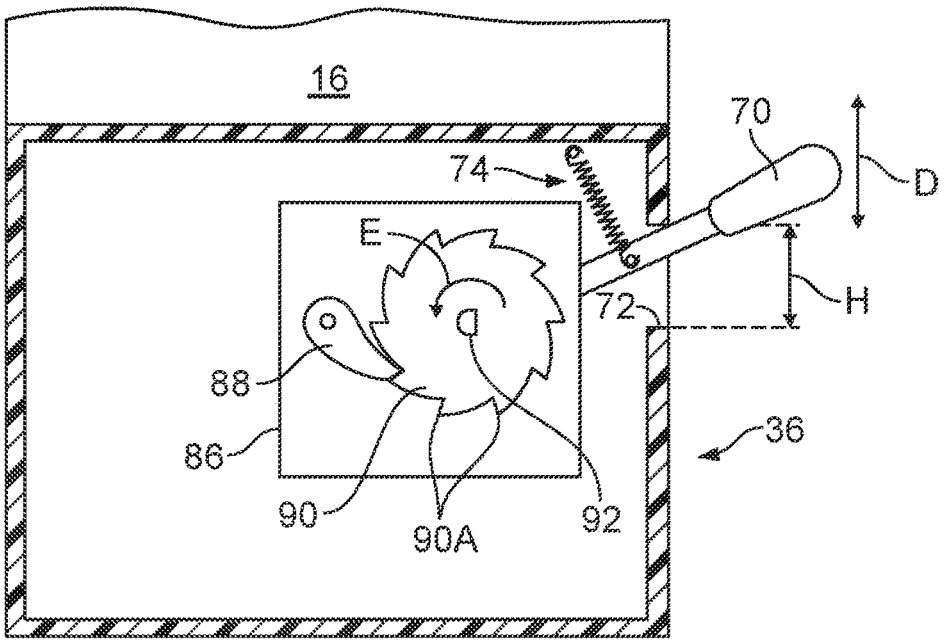
FIG. 5 is a cross-sectional view of a portion of the housing taken along line 5-5 in FIG. 1.

As shown in the cross-sectional schematic view of FIG. 5, the gear assembly 86 may comprise one or more gears arranged in one of several known configurations that allow metered movement of a dispensing gear 90. The lever 70 may be coupled, via one or more additional gears and/or other components (not shown), to the dispensing gear 90, such that depression of the lever 70 downward in a direction indicated by arrow D causes the dispensing gear 90 to rotate a predefined rotational distance in a direction indicated by arrow E. In one example, the dispensing gear 90 may comprise a ratchet that allows rotation in only one direction. As the lever 70 is depressed from a first position and the dispensing gear 90 rotates in the direction indicated by arrow E, a pawl 88 slides over each tooth 90A of the dispensing gear 90. When the lever 70 is released and moves upward, the pawl 88 prevents reverse rotation of the dispensing gear 90, i.e., in a direction opposite to the arrow E, as is known in the art. Although the dispensing gear 90 is depicted in FIG. 5 as a ratchet, the dispensing gear 90 may comprise any suitable type of gear, such as a conventional spur gear, and the gear assembly 86 may include gears with internal and/or external gears.

In other examples (not shown), the lever 70 may be coupled to a rack that engages a pinion, which may drive one or more additional gears to cause rotation of the dispensing gear 90 upon depression of the lever 70 in a known manner. Alternatively, or in addition, the gear assembly 86 may comprise a conventional, single direction clutch (not shown) that disconnects the lever 70 from the dispensing gear 90 during the upward or return movement of the lever 70 to the first position, such that the upward movement of the lever 70 does not cause reverse rotation of the dispensing gear 90. Suitable lever-operated gear assembly structures are described, for example, in U.S. Pat. Nos. 4,406,421; 4,699,304; and 6,224,010, the disclosures of which are hereby incorporated by reference in their entirety.

Alternatively, or in addition, the gear compartment 36 in further examples may comprise a winding mechanism with a wheel or knob 78 located on the side panel 38, as shown in FIG. 3. The knob 78 may comprise a shaft (not shown) that extends through the side panel 38 and is coupled to, for example, a spiral torsion spring (not shown). The spiral spring may be similar to a clock mainspring and may be coupled to a ratchet (not shown). As is known in the art, turning the knob 78 in one direction tightens the spiral spring, with the pawl preventing turning of the knob 78 in the opposite direction and unwinding of the spiral spring. The spiral spring may be coupled to the dispensing gear 90 (directly or via one or more additional gears), and the lever 70 may be coupled to an escapement (not shown) such that the spiral spring releases a metered amount of energy with each depression of the lever 70 in a known manner, causing the dispensing gear 90 to rotate the predefined rotational distance and dispense the paper product 100, as described herein. The knob 78 may be periodically turned to re-tighten the spiral spring as needed.

The gear compartment 36 may comprise a biasing mechanism that biases the lever 70 back to the first position following depression of the lever 70. The biasing mechanism may comprise, for example, an extension spring 74 that may be coupled at one end to the lever 70 and at the other end to an inner surface of the gear compartment 36. The lever 70 is depressed downward in the direction indicated by arrow D from the first position shown in FIG. 5, and upon release of the lever 70, the spring 74 biases the lever 70 upward to return the lever 70 to the first position. A height H of the slot 72 may at least partially determine a degree of upward and downward movement of the lever 70 in the direction indicated by the arrow D. The predefined rotational distance by which the dispensing gear 90 rotates upon depression of the lever 70 may be at least partially defined by the height H of the slot 72. Alternatively, or in addition, when the dispensing gear 90 comprises a ratchet, the predefined rotational distance by which the dispensing gear 90 rotates upon depression of the lever 70 may be at least partially defined by a spacing between the teeth 90A of the dispensing gear 90. With reference to FIGS. 2B, 5, and 6, the predefined rotational distance may substantially correspond to a dimension between the perforations 104 that define the individual sheets 102 of the rolled paper product 100, in which the dimension between the perforations 104 is measured in the direction indicated by the arrow B. For a stacked paper product (not shown), the predefined rotational distance may substantially correspond to a dimension of the separate sheets.

As shown in FIGS. 1 and 5, the second side panel 20 of the housing 12 comprises an opening 34 that extends through a thickness of the gear compartment 36. The opening 34 aligns with a central aperture 92 of the dispensing gear 90. When the cartridge 40 is installed in the housing 12, the shaft 66 coupled to the active roller 62 extends through the opening 34 and is received in the central aperture 92 of the dispensing gear 90. The central aperture 92 may comprise a shape with, for example, an arcuate portion and a flattened portion (not separately labeled), as seen in FIG. 5. The shaft 66 may comprise a shape that corresponds to the shape of the central aperture 92, such that the shaft 66 moves in conjunction with the dispensing gear 90. In other examples (not shown), the central aperture 92 and shaft 66 may comprise a square or rectangular shape.

With reference to FIGS. 1, 2A, 2B, and 5, depression of the lever 70 causes the dispensing gear 90 to rotate the predefined rotational distance in the direction indicated by arrow E. Rotation of the dispensing gear 90 causes the shaft 66 of the active roller 62 to rotate a corresponding rotational distance in a direction indicated by arrow A. Because the active and passive rollers 62, 64 contact each other and compress the sheet 102 of the paper product 100 between them, friction between the active and passive rollers 62, 64 causes the passive roller 64 to rotate in a direction opposite to the arrow A. This rotation of the active and passive rollers 62, 64 causes the sheet 102 of the rolled or stacked paper product 100 extending from the slot 60 to move in the direction indicated by arrow B. In this manner, sheets 102 of the paper product 100 are dispensed one at a time from the cartridge 40. Upon release, the spring 74 biases the lever 70 upward and returns the lever 70 to the first position in preparation for one or more subsequent depressions of the lever 70 and dispensation of one or more additional sheets 102 of the paper product 100. Compression of the paper product 100 between the active and passive rollers 62, 64 keeps the paper product 100 from retracting back into the cartridge 40 between depressions of the lever 70. Upon depletion of the paper product 100, the cartridge 40 may be removed from the housing 12 as described herein for refilling or disposal.

Figure 7:
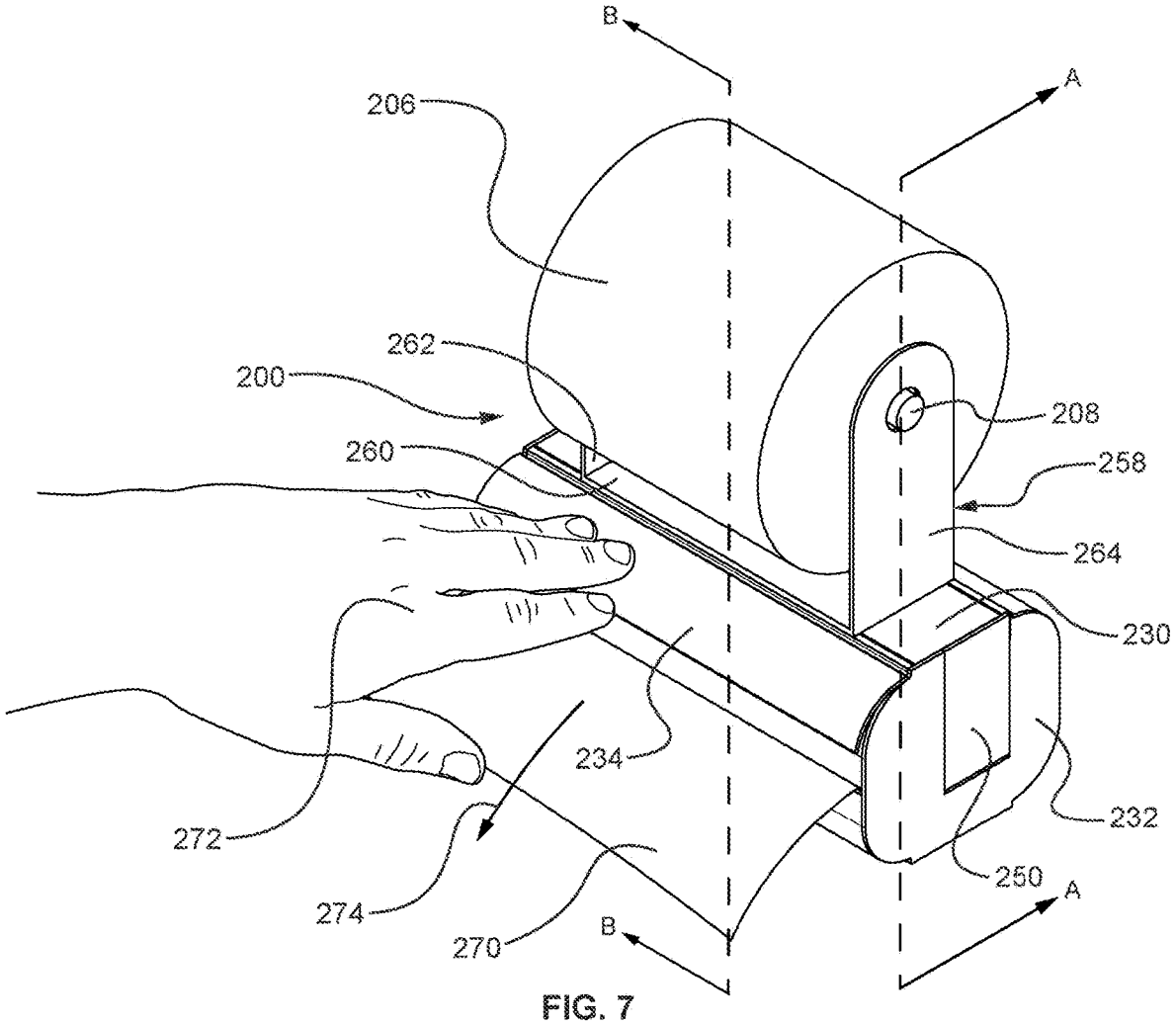
FIG. 7 is a front perspective view of a second embodiment of a dispensing assembly comprising a housing and a cartridge in accordance with principles of the present disclosure.
Figure 8:
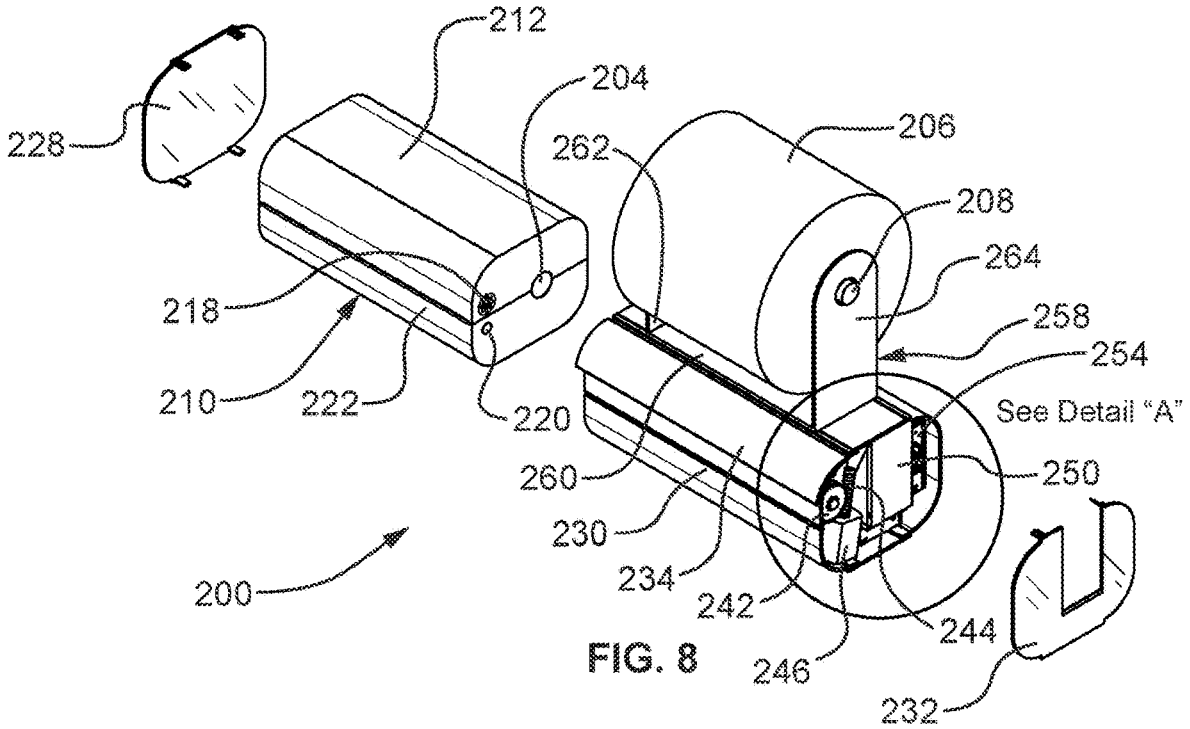
FIG. 8 is a partially exploded view of the dispensing assembly of FIG. 7.
Figure 10:
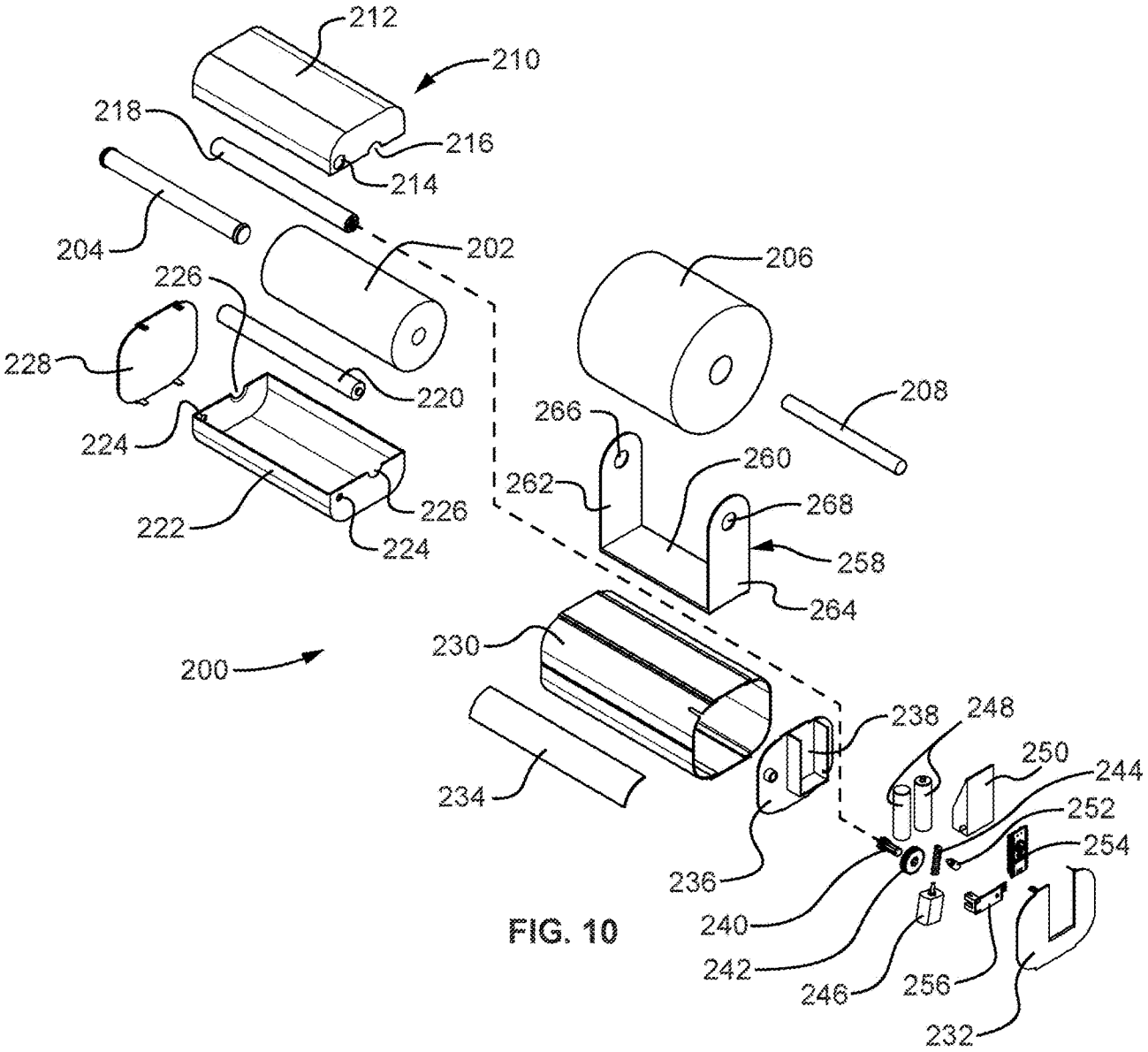
FIG. 10 is an exploded perspective view of the dispensing assembly of FIG. 7.

With reference to FIGS. 7, 8, and 10, a dispensing assembly 200 in accordance with a second embodiment of the present disclosure is depicted. The dispensing assembly 200 comprises a housing 230 and a cartridge 210. The housing 230 and the cartridge 210 may each comprise one or more polymeric materials and may consist at least partially of recycled and/or recyclable materials. The housing 230 may comprise a plurality of side panels that together define a compartment into which the cartridge 210 is removably received, as described herein. The housing 230 may comprise an elongate body portion (see FIGS. 7 and 10) with the plurality of side panels and a pair of end caps 228, 232 for attaching to opposed ends of the elongate body portion. The dispensing assembly 200 may further comprise an actuation subassembly 240, 242, 244, 246 being disposed in the housing, the actuation subassembly 240, 242, 244, 246 being configured to advance the paper product 270 disposed in the cartridge 210.

Referring again to FIGS. 7, 8, and 10, it can be seen that the dispensing assembly 200 may further comprise a hanger component 258. The banger component 258 is attached to the top of the housing 230 (see FIG. 7), and the hanger component 258 comprising a pair of arms 262, 264 that suspend the housing 230 below a spindle (e.g., a toilet paper roll core 208). The pair of arms 262, 264 extend upwardly in a generally perpendicular manner from a base 260. The first arm 262 comprises a first spindle aperture 266 for receiving a first end of the spindle 208, while the second arm 264 comprises a second spindle aperture 268 for receiving a second oppositely disposed end of the spindle 208. As shown in FIG. 7, the toilet tissue roll 206 may be placed on the spindle 208, and the toilet tissue roll 206 and the dispensing assembly 200 may be supported in a suspended manner from a bracket mounted on a wall or partition.

With reference to FIGS. 8 and 10, the cartridge 210 comprises a top portion 212 and a bottom portion 222. In some embodiments, the top portion 212 may be coupled to the bottom portion 222 in a clamshell-type configuration. In other embodiments, the top portion 212 may be coupled to the bottom portion 222 by a hinge extending longitudinally along one of the elongate sides of the cartridge 210. The hinge may comprise a strip of thin, flexible material adhered to the cartridge 210 and spanning between the top portion 212 and the bottom portion 222. The top portion 212 of the cartridge 210 may pivot along the hinge to allow access to an interior space of the cartridge 210.

Figure 12:
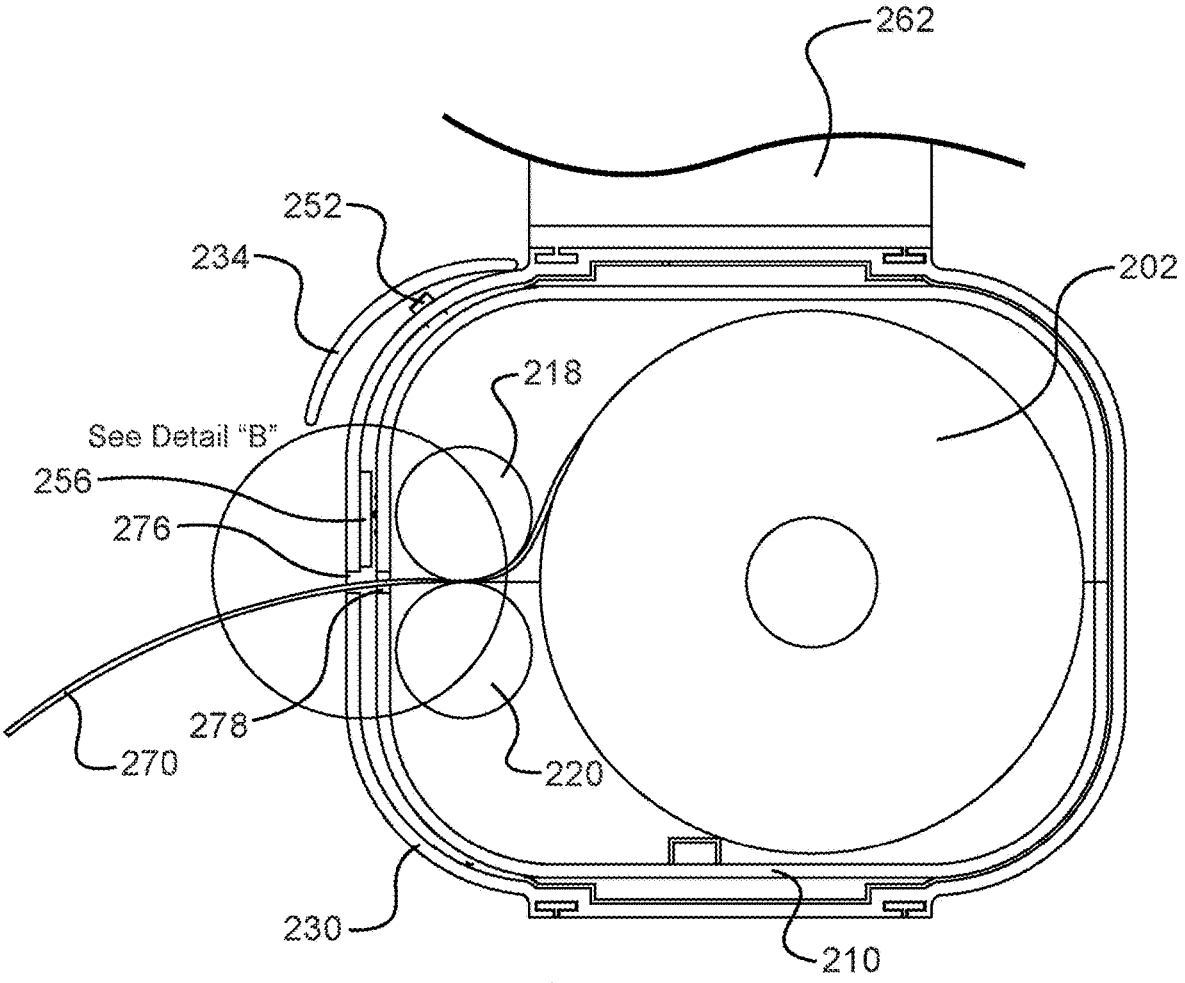
FIG. 12 is a transverse sectional view cut through the dispensing assembly of FIG. 7, wherein the section is cut based on the cutting-plane line B-B in FIG. 7.

The cartridge 210 may be for dispensing a paper product 270, as shown in FIGS. 7 and 12. The cartridge 210 may accommodate a variety of wet paper products and may be refillable. The paper product 270 may comprise, for example, a rolled, continuous sheet of a pre-wetted paper product 202 (see FIG. 8), such as a personal wipe (commonly referred to as a wet wipe or moist towelette), which may be disposable and/or flushable (i.e., may be flushed down a toilet for disposal with other solid waste). Alternatively, the paper product 270 may comprise non-flushable wipes for tabletop use, as described hereinafter with regard to FIG. 15. As shown in the detail view of FIG. 13, the paper product 270 may comprise a line of weakness or perforations that define individual sheets. In some embodiments, the cartridge 210 is in the form of a self-contained cartridge where the cartridge 210 completely houses the pre-wetted paper product roll 202. The self-contained cartridge 210 may have the paper product roll 202 preloaded therein as a single use item, or the paper product roll may also be reloaded by the user (i.e., to replace an empty paper product roll 202).

Figure 11:
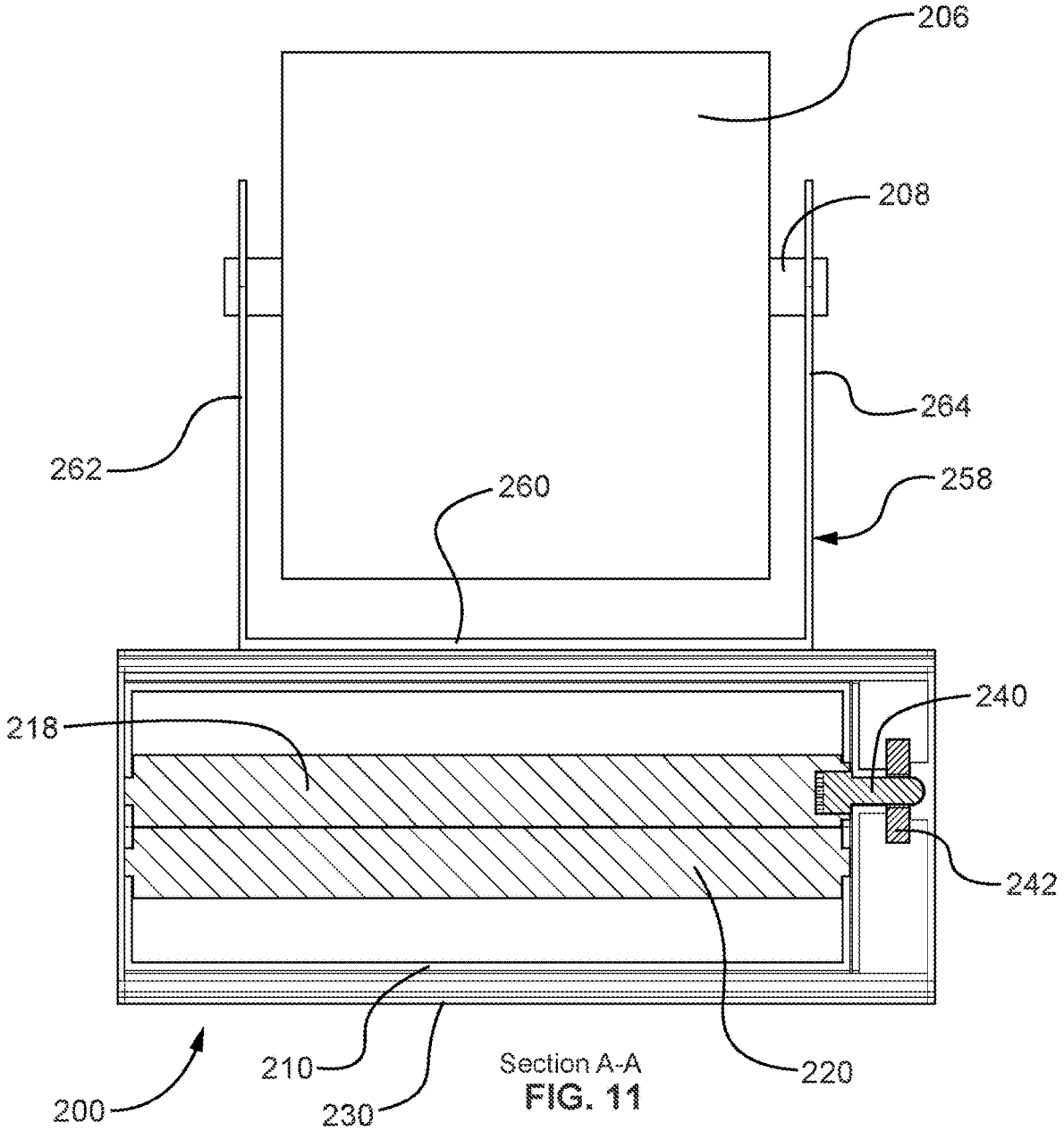
FIG. 11 is a longitudinal sectional view cut through the dispensing assembly of FIG. 7, wherein the section is cut based on the cutting-plane line A-A in FIG. 7.

The cartridge 210 comprises an active roller 218 and a passive roller 220, as shown in FIGS. 11 and 12. The active roller 218 is rotatably coupled to and contained in the top portion 212 of the cartridge 210. The active roller 218 comprises a notched end that engages with a spline at one end of the drive shaft 240. The notched end of the active roller 218 is received within an aperture 214 formed in the top portion 212 of the cartridge 210, such that the notched end of the active roller 218 is accessible from the outside of the cartridge 210. The passive roller 220 is rotatably coupled to and contained in the bottom portion 222 of the cartridge 210. As best shown in FIG. 8, the bottom portion 222 of the cartridge 210 contains a pair of opposed apertures 224 for receiving the opposed ends of the passive roller 220. As shown in FIG. 11, the active roller 218 is disposed adjacent to the passive roller 220 when the cartridge 210 is in its closed state.

Also, as shown in FIG. 10, the cartridge 210 further comprises a roller core 204 on which the paper product roll 202 is supported. The opposed ends of the roller core 204 are received within opposed semi-circular notches 216 in the top portion 212 of the cartridge 210 and opposed semi-circular notches 226 in the bottom portion 222 of the cartridge 210.

Figure 14:
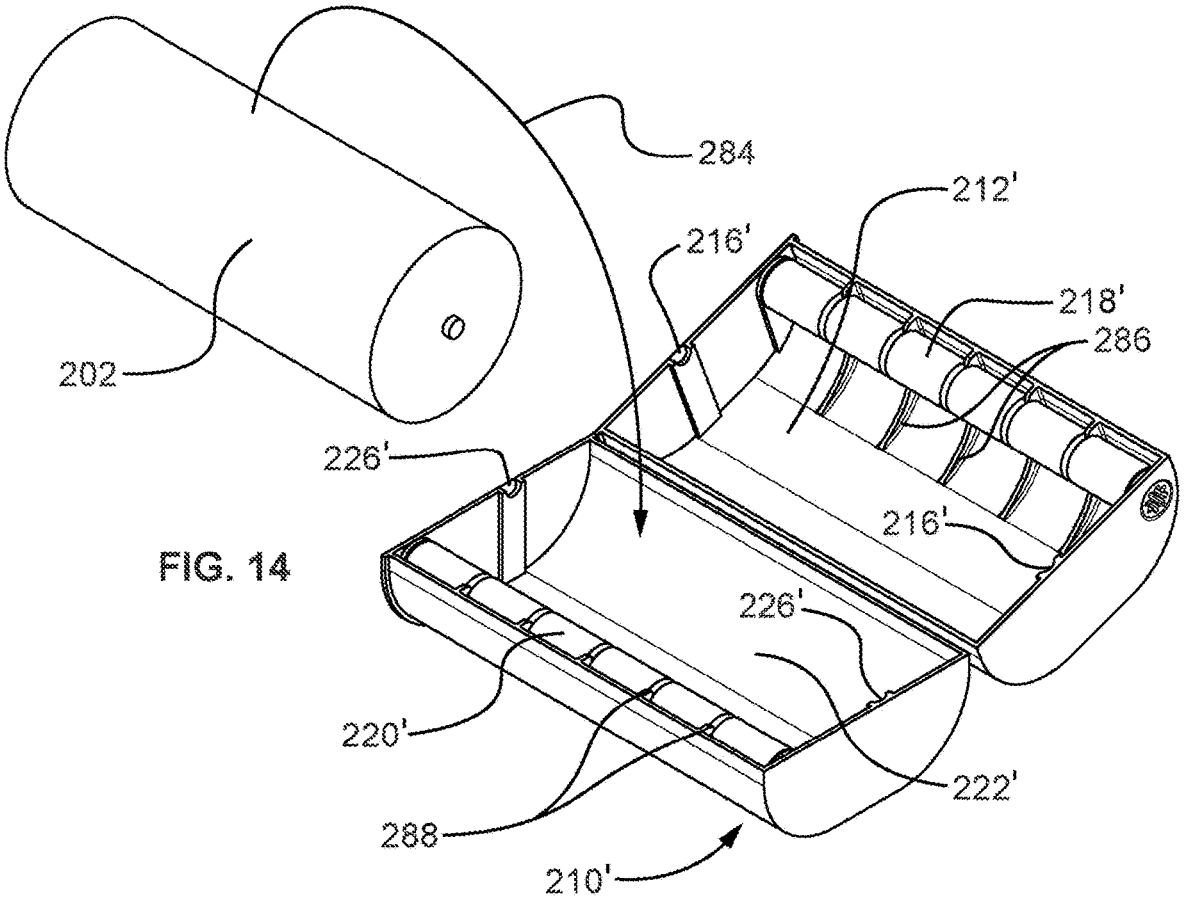
FIG. 14 is a perspective view illustrating the loading of a wet wipe roll into the cartridge of the dispensing assembly of FIG. 7.

An alternative embodiment of the cartridge 210' is shown in FIG. 14. The cartridge 210' is similar in most respects to the cartridge 210 described above. For example, like the cartridge 210, the cartridge 210' comprises a top portion 212' with an active roller 218' and a bottom portion 222' with a passive roller 222'. Although, unlike the cartridge 210, the cartridge 210' is provided with a plurality of ribs 286 in the cartridge top portion 212', a plurality of ribs 288 in the cartridge bottom portion 288, and flat surfaces along a dispensing edge of the paper product 202 for supporting the paper product during dispensing. As shown in FIG. 14, the active and passive rollers 218', 222' are provided with circumferential notches formed therein in order to accommodate the respective ribs 286, 288. In the alternative embodiment, the paper product roll 202 has opposed protrusions that are received within opposed semi-circular notches 216' in the top portion 212' of the cartridge 210' and opposed semi-circular notches 226' in the bottom portion 222' of the cartridge 210'.

With continued reference to FIG. 14, to install the paper product roll 202 in the cartridge 210', the top portion 212' of the cartridge 210' is opened and the paper product 202 is placed into the cartridge 210 in the direction indicated by the curved arrow 284. A first sheet of the rolled paper product 202 is placed over the passive roller 220, 220' in the bottom portion 222, 222' and inserted into a slot 278 (see FIG. 12) such that the sheet extends through the slot 278 between the top portion 212, 212' and the bottom portion 222, 222' and extends outward from the front side of the cartridge 210, 210'. When the top portion 212, 212' is closed, the active roller 218, 218' contacts the sheet and compresses the paper product 202 between the active roller 218, 218' and passive rollers 220, 220'. The active and passive rollers 218, 218', 220, 220' may be formed from and/or coated or covered with a non-slip or gripping material. One or both of the active roller 218, 218' or the passive roller 220, 220' may also comprise a spring or other structure (not shown) that biases the rollers 218, 218', 220, 220' toward each other.

The active and passive rollers 218, 220 together form a seal across the slot 278 through which the paper product 202 is dispensed. This seal may be partially watertight, which helps to reduce loss of moisture from the paper product 202. In addition, the self-contained cartridge 210 fully encloses the paper product 2020 on all sides, which further helps to reduce loss of moisture from the paper product 202. Compression of the paper product 202 between the rollers 218, 220 also helps to prevent retraction or withdrawal of the paper product 202 back through the slot 278 and into the cartridge 210. As described in more detail herein, the active and passive rollers 218, 220 cooperate to dispense sheets of the paper product 202 via the slot 278 in a direction indicated by arrow 274 in FIG. 7.

As shown in FIGS. 8 and 10, the housing compartment is enclosed on only four sides (e.g., by the side, top, and back panels of the housing 230), with the two opposed ends of the housing 230 being open. The cartridge 210 may be aligned with the housing compartment and inserted into the housing compartment through the end of the housing 230 with removable end cap 228. The removable end cap 228 may have resilient tabs that snap onto the end of the housing 230. In an alternative embodiment, the end cap 228 may be integrated into the end of the cartridge 210.

Figure 9:
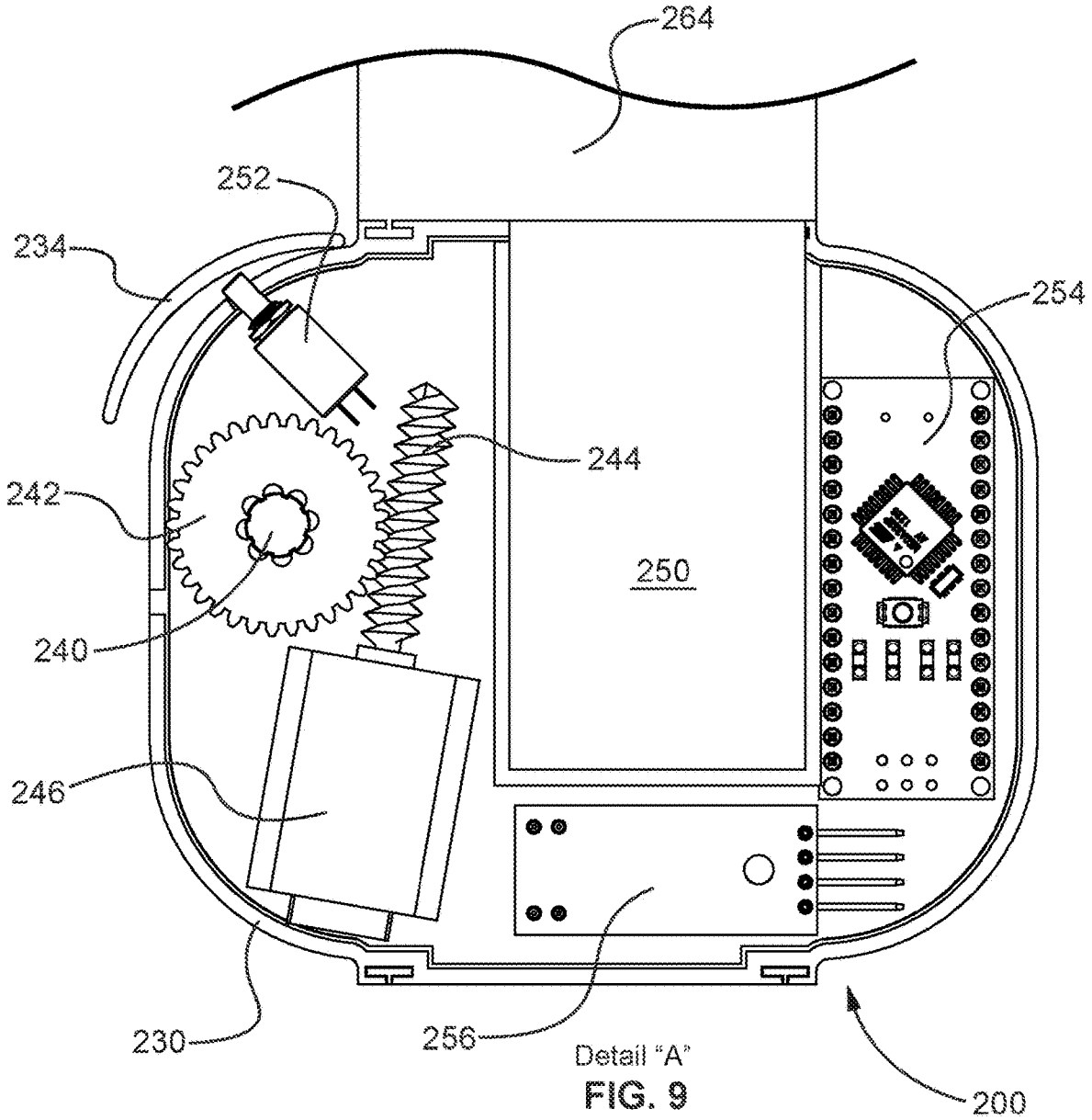
FIG. 9 is a detailed view of the actuator compartment in the housing of the dispensing assembly of FIG. 7 (Detail "A")

With reference to FIGS. 8-10, a portion of the housing 230 adjacent to the housing compartment may further comprise an actuator compartment that encloses the various components of the actuation subassembly 240, 242, 244, 246. The actuator compartment may be defined on four sides by the housing 230, on a fifth side by the housing interior wall 236, and on a sixth side by the removable end cap 232. The actuator compartment is disposed opposite to the end of the housing with removable end cap 228.

As shown in FIG. 10, the housing interior wall 236 comprises an opening that accommodates the drive shaft 240 extending therethrough. The opening in the housing interior wall 236 aligns with a central aperture of the drive gear 242. When the cartridge 210 is installed in the housing 230, the drive shaft 240 coupled to the active roller 218 extends through the opening in the housing interior wall 236 and is received in the central aperture of the drive gear 242. The central aperture of the drive gear 242 may comprise a shape with, for example, circumferential notched portions, as seen in FIG. 9. The drive shaft 240 may comprise a shape that corresponds to the shape of the central aperture of the drive gear 242, such that the drive shaft 240 moves in conjunction with the drive gear 242. In other examples (not shown), the central aperture of the drive gear 242 and the drive shaft 240 may comprise a square or rectangular shape.

Now, with reference to FIGS. 9-11, the actuation subassembly 240, 242, 244, 246 of the dispensing assembly 200 will be described in detail. In the second embodiment, the actuation subassembly comprises the drive shaft 240, the drive gear 242, a worm gear 244, and drive motor 246. The drive gear 242 is operatively coupled to the drive motor 246 and to the active roller 218 via the drive shaft 240, and when the actuation button 234 is depressed on the front of the housing 230, the drive gear 242 and the active roller 218 rotate a predefined rotational distance to advance the paper product 202. As best shown in FIG. 9, the drive gear 242 is operatively coupled to the drive motor 246 via a worm gear 244. Referring again to FIGS. 9 and 10, the actuation subassembly further comprises a control board 254, a microswitch 252, and an infrared sensor 256 disposed in the actuator compartment of the housing 230. The microswitch 252 and the infrared sensor 256 are both electrically coupled to the control board 254.

In the second embodiment, the drive motor 246 is electrically powered by the batteries 248, which are located in the battery compartment 238 of the housing interior wall 236. The front of the battery compartment is enclosed by a removable cover 250, which may be pivotably mounted to opposed walls of the battery compartment 238 so as to allow the batteries 248 to be easily accessed when needed for replacement.

Figure 13:
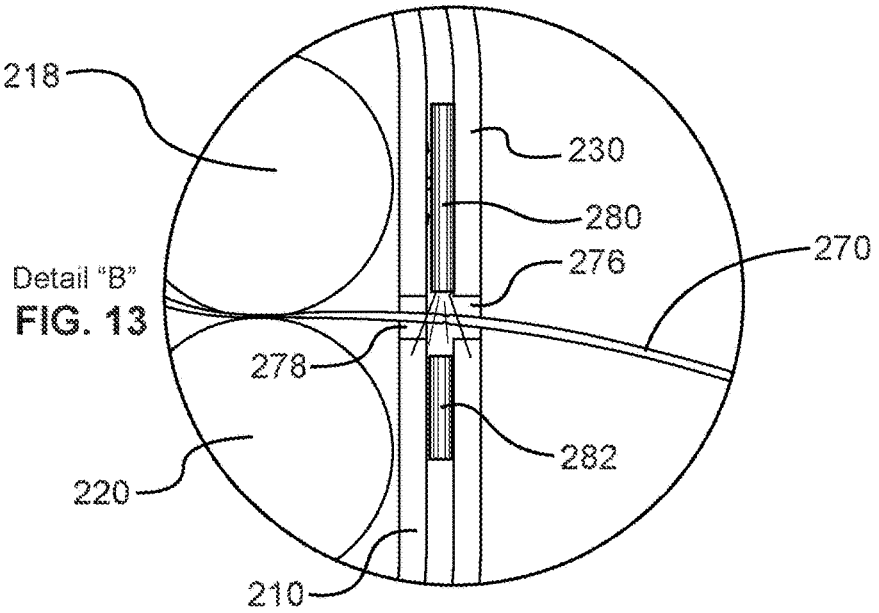
FIG. 13 is a detailed view of the optical sensor of the dispensing assembly depicted in FIG. 12 (Detail "B")

In the second embodiment, referring to FIG. 13, the infrared sensor 256 may comprise a photo interrupter arrangement with an infrared wavelength (IR) light emitting diode (LED) 280 and a phototransistor detector 282 positioned face-to-face on an optical axis. The components 280, 282 are positioned such that the dispensed wet wipe product 270 passes between the IR LED 280 and the detector 282. These components 280, 282 may be in a combined package or separate discrete components. When a wipe 270 is positioned between the sensor components 280, 282, the transistor is turned "off". When a perforation or line of weakness of the wipe 270 passes between the emitter 280 and detector 282, the IR light emitted by the LED 280 reaches the phototransistor and turns the transistor "on". The phototransistor output is connected to the control electronics of the control board 254 to signal that the position of the wipe perforation or line of weakness is near the output opening or slot 278.

The electronic control circuit of the control board 254 performs various functions in the second embodiment of the dispensing assembly 200. First, the electronic control circuit of the control board 254 results in the dispensing of exactly one pre-moistened wipe 270 from the internal cartridge 210 for each press of the actuation button 234. Secondly, the electronic control circuit of the control board 254 turns off the drive motor 246 at the correct time so that the perforation on the wipe product 270 aligns with the dispensing slot 278. This allows the dispensed product to easily be retrieved by the user by separating the single dispensed wipe from the device. Also, in other embodiments, the electronic control circuit of the control board 254 in conjunction with the infrared sensor 256 may monitor the amount of paper product remaining in the cartridge 210 and alert the user through a visible or audible warning when amount of remaining product is considered "low". The electronic control circuit may be implemented using commercially available electronics components on a custom printed circuit board (PCB) 254. The circuit design utilizes common analog and digital design techniques. Logic control may be achieved using a microcontroller with custom software, digital logic timer/counter integrated circuits, or a combination of these.

In the second embodiment, when a user presses the actuation button 234 with his or her hand 272 on the front of the housing 230 (see FIG. 7), the microswitch 252 is in turn depressed by the actuation button 234, and a control signal is sent to the control board 254. Upon the actuation of the microswitch 252, the control circuit in the control board 254 turns the drive motor 246 on and also starts a timer. The timer's expiration time is pre-programmed to be longer than the typical time required to dispense a single wet wipe. If the photo interrupter does not detect the wipe perforation or line of weakness (see FIG. 13), the drive motor 246 will run for this predetermined time and then stop. This prevents inadvertent dispensing of the entire roll 202 in the event of a sensing failure. When the perforation or line of weakness is detected by the photo interrupter, the first timer is canceled. A second timer is started. Expiry of this second timer stops the drive motor 246. The run time of the second timer is configured to allow the wipe perforation to pass fully beyond the drive rollers 218, 220 and the output slot 276 in the housing 230. The additional motor drive time controlled by the second timer: (a) ensures that the perforation or line of weakness is out far enough to facilitate easy removal of the wipe and (b) prevents the next wipe from losing contact with the drive rollers 218, 220.

When the drive motor 246 is activated by the control circuit in the control board 254, the drive motor 246 rotates the worm gear 244, which in turn, rotates the drive gear 242. Rotation of the drive gear 242 causes the drive shaft 240 of the active roller 218 to rotate a corresponding rotational distance. Because the active and passive rollers 218, 220 contact each other and compress the sheet of the paper product 202 between them, friction between the active and passive rollers 218, 220 causes the passive roller 220 to rotate in a direction opposite to the active roller 218. This rotation of the active and passive rollers 218, 220 causes the sheet of the rolled or stacked paper product 202 extending from the slot 276 to move in the direction indicated by arrow 274 in FIG. 7. In this manner, sheets of the paper product 202 are dispensed one at a time from the cartridge 210. Compression of the paper product 202 between the active and passive rollers 218, 220 keeps the paper product 202 from retracting back into the cartridge 210 between depressions of the actuation button 234. Upon depletion of the paper product 202, the cartridge 210 may be removed from the housing 230 as described herein for refilling or disposal (see FIG. 8)

Figure 15:
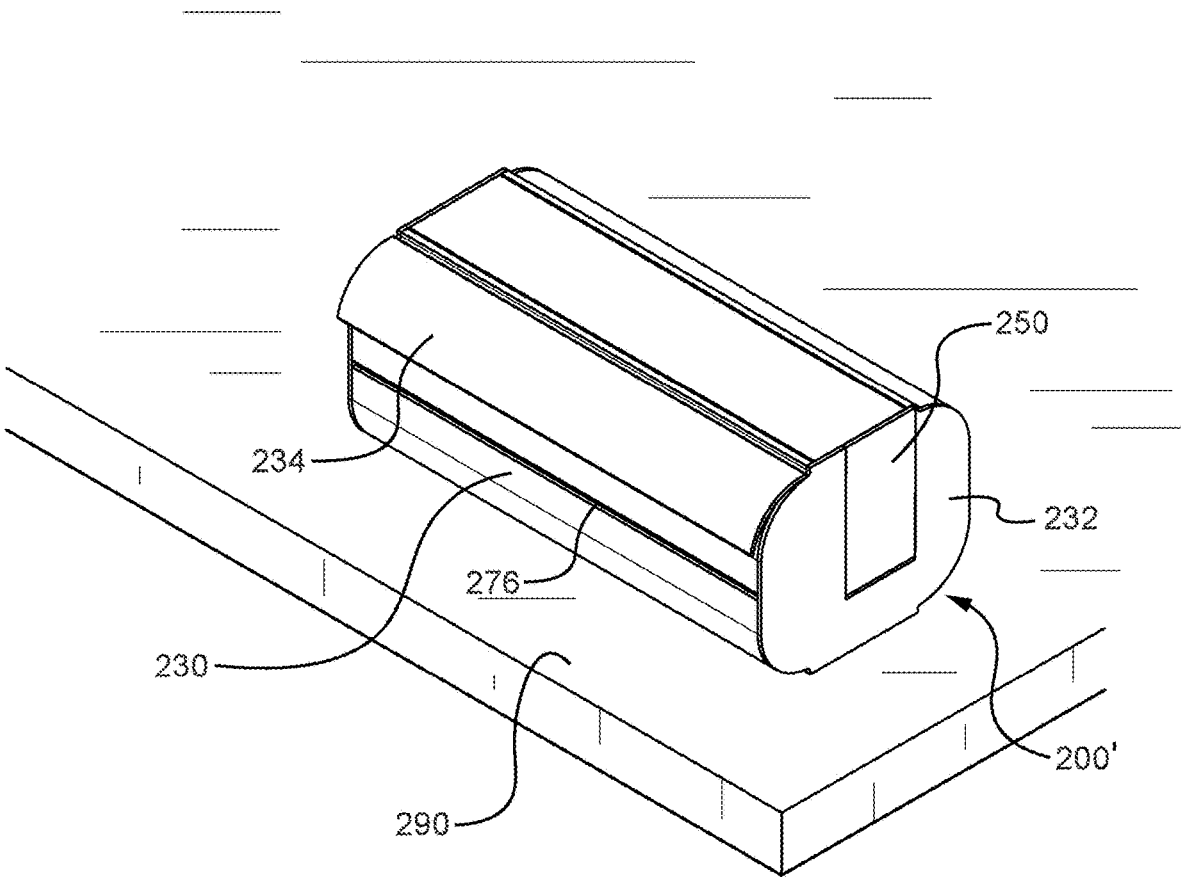
FIG. 15 is a front perspective view of a third embodiment of a dispensing assembly comprising a housing and a cartridge in accordance with principles of the present disclosure.

With reference to FIG. 15, a dispensing assembly 200' in accordance with a third embodiment of the present disclosure is depicted. The dispensing assembly 200' of FIG. 15 is generally the same as the dispensing assembly 200 described above, except that the dispensing assembly 200' is configured to be disposed on a table 290, rather than being suspension mounted from a spindle 208. As such, the dispensing assembly 200' of the third embodiment is not provided with the hanger component 258, but rather the dispensing assembly 200' may be provided with a plurality of pads (e.g., four (4) polymeric pads) on the bottom of the housing 230 for allowing the dispensing assembly 200' to rest on a tabletop or other horizontal surface.

Figure 16:
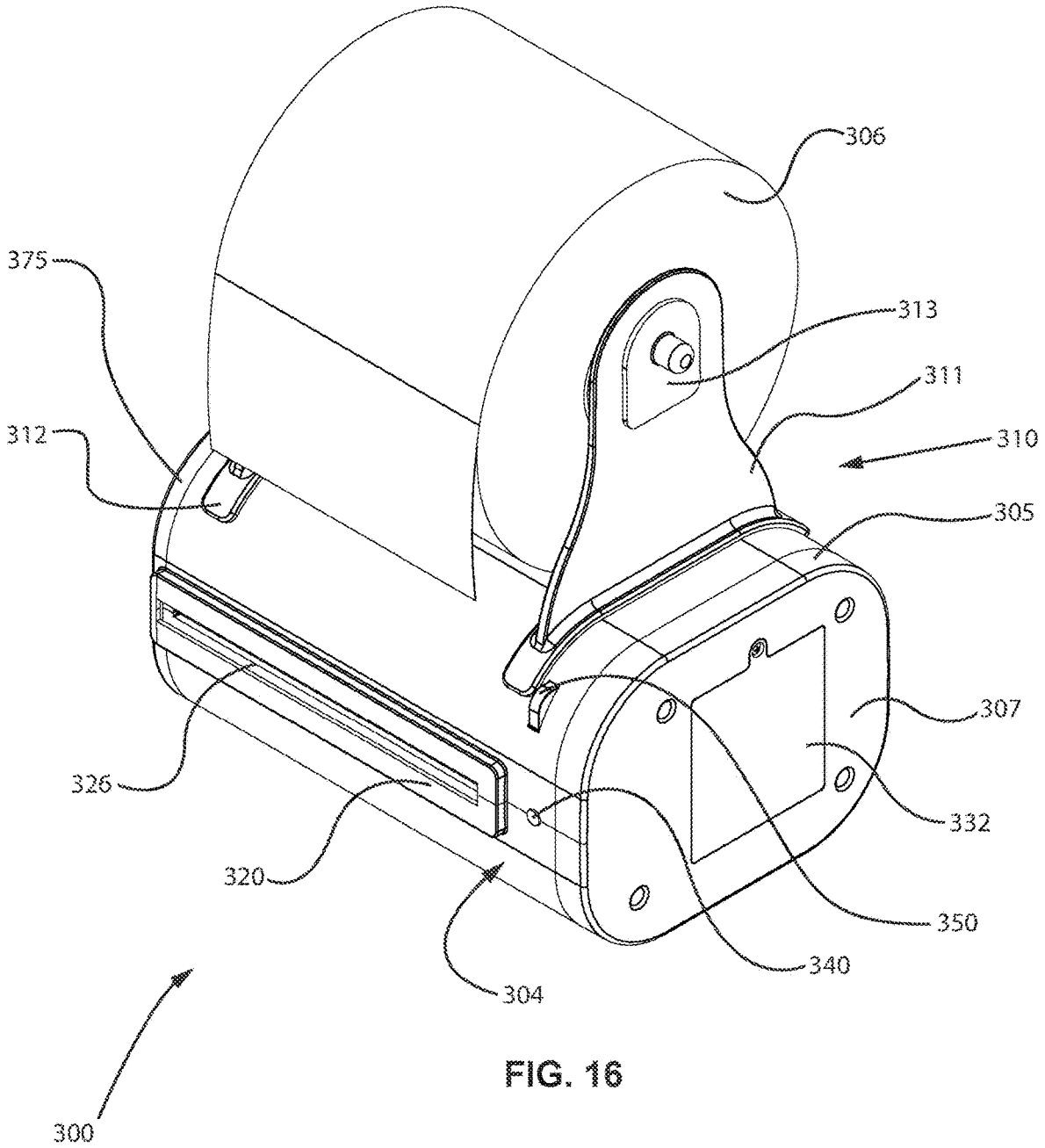
FIG. 16 is a front-top perspective view of a fourth embodiment of a dispensing assembly comprising a housing and a cartridge in accordance with principles of the present disclosure.
Figure 23:
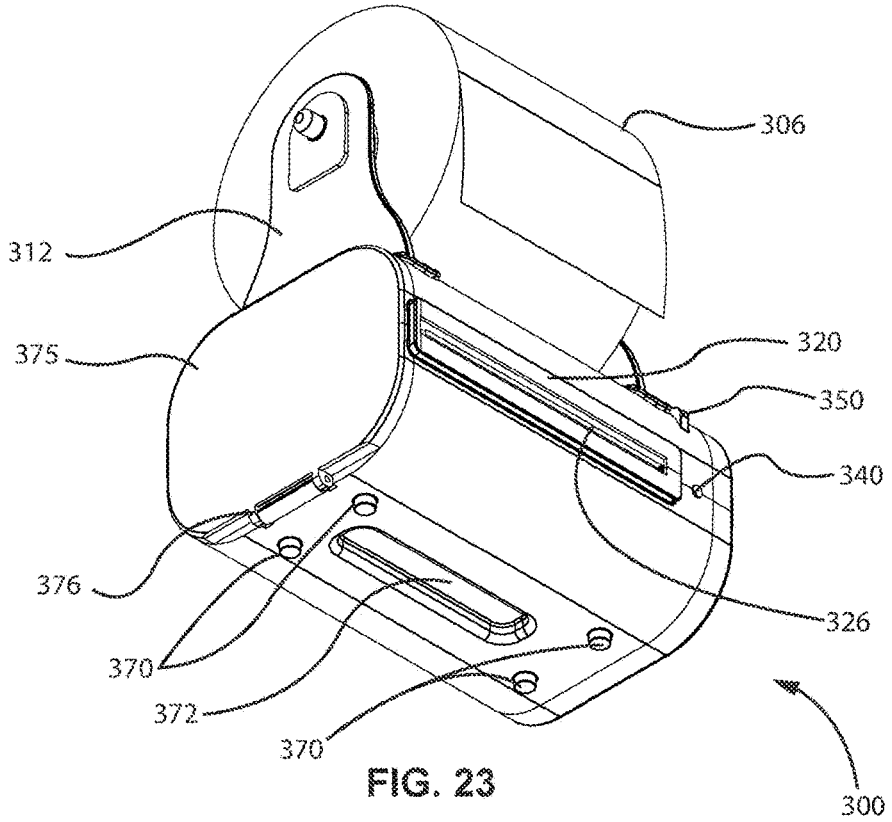
FIG. 23 is a bottom-front perspective view of the dispensing assembly of FIG. 16.
Figure 24:
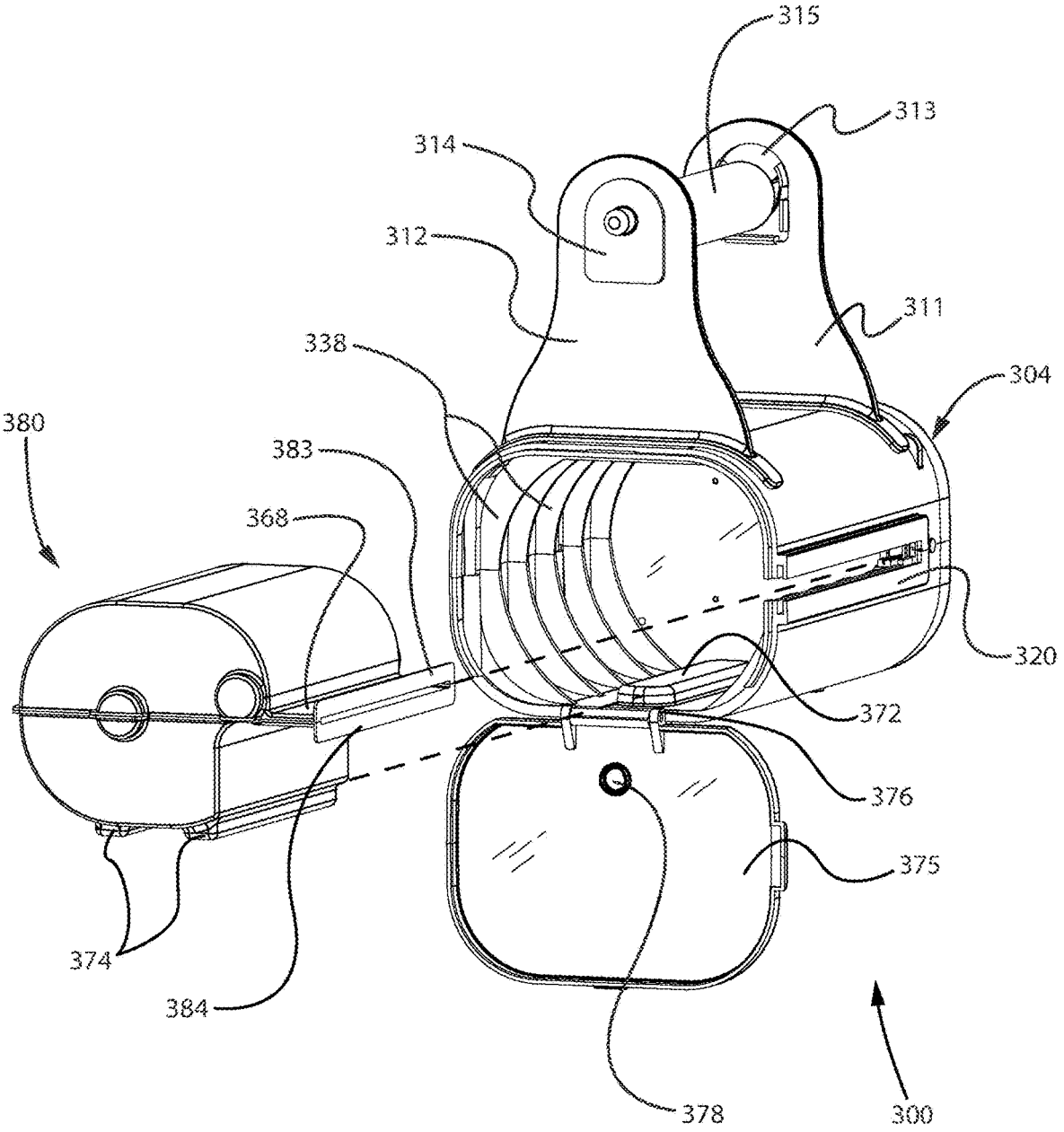
FIG. 24 is a partially exploded view of the dispensing assembly of FIG. 16, where the hinged door of the housing is open, and the cartridge has been removed from the housing.
Figure 25:
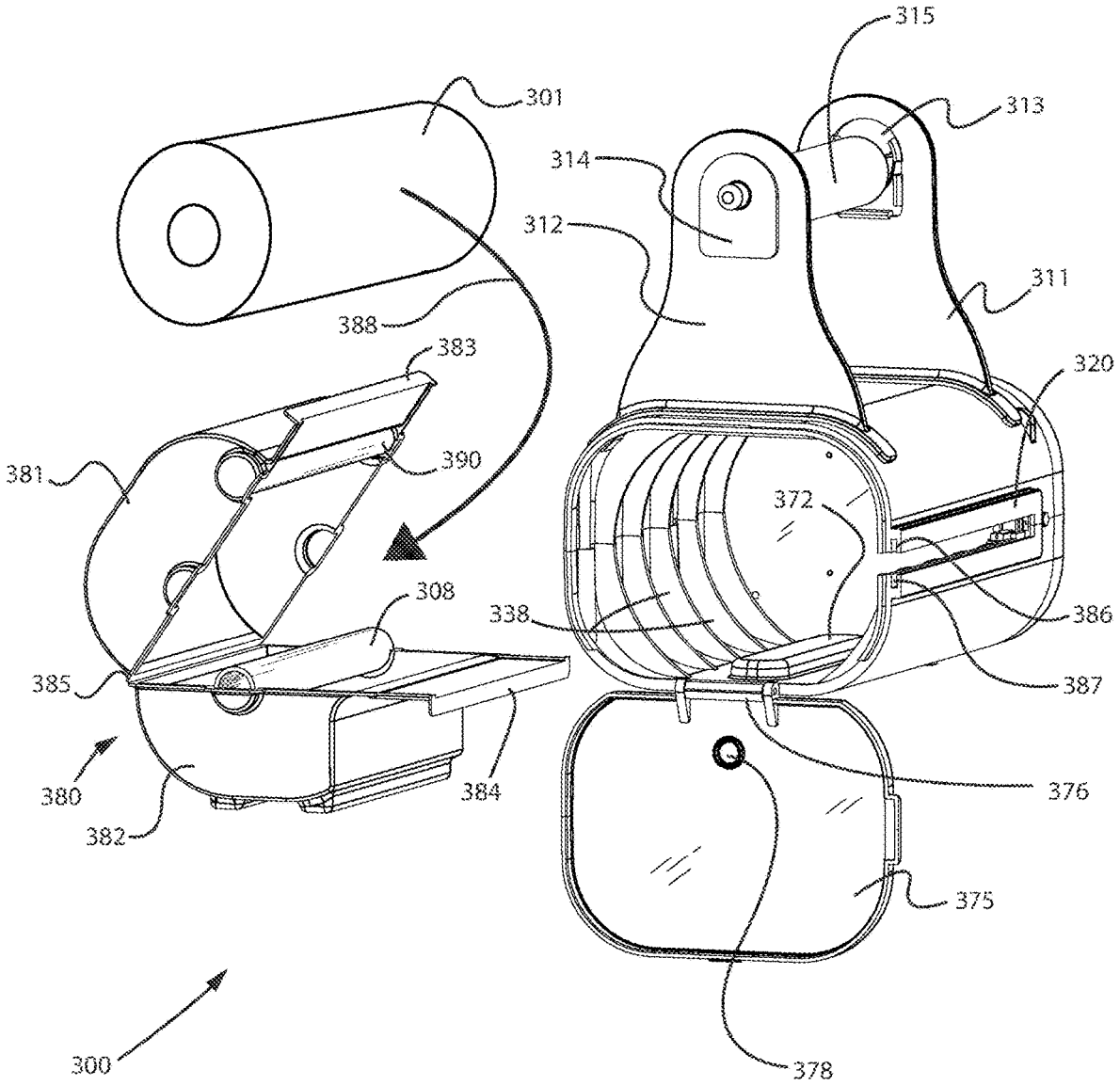
FIG. 25 is another partially exploded view of the dispensing assembly of FIG. 16, where the hinged door of the housing is open, the cartridge has been removed from the housing, and the loading of a wet wipe roll into the cartridge of the dispensing assembly is shown.

With reference to FIGS. 16, 23, and 24, a dispensing assembly 300 in accordance with a fourth embodiment of the present disclosure is depicted. The dispensing assembly 300 comprises a housing 304 and a cartridge 380. The housing 304 and the cartridge 380 may each comprise one or more polymeric materials and may consist at least partially of recycled and/or recyclable materials. The housing 304 may comprise a plurality of side panels that together define a compartment into which the cartridge 380 is removably received, as described herein. The housing 304 may comprise an elongate body portion 305 (see FIGS. 16 and 17) with the plurality of side panels and a pair of end caps 307, 375 for attaching to opposed ends of the elongate body portion 305. As shown in FIG. 25, the elongate body portion 305 of the housing 304 may be provided with a plurality of internal ribs 338 for increasing the strength and rigidity of the housing 304, as well as defining an interior contour of the compartment of the housing 304 that corresponds to the shape of the cartridge 380. The dispensing assembly 300 may further comprise an actuation subassembly 391, 392, 393 being disposed in the housing (see FIG. 20), the actuation subassembly 391, 392, 393 being configured to advance the paper product 301 disposed in the cartridge 380.

Referring again to FIGS. 16 and 17, it can be seen that the dispensing assembly 300 may further comprise a hanger component 310. The hanger component 310 is attached to the top of the housing 304 (see FIG. 16), and the hanger component 310 comprising a pair of arms 311, 312 that may suspend the housing 304 below a spindle (e.g., a toilet paper roll core 315). The pair of arms 311, 312 extend upwardly in a generally perpendicular manner from an upper surface of the housing 304. The first arm 311 comprises a first removable insert plate 313 and the second arm 312 comprises a second removable insert plate 314 (e.g., the removable insert plates 313, 314 have resilient prongs for snapping into the respective apertures in the arms 311, 312). The removable insert plates 313, 314 allow the hanger component 310 to accommodate different configurations of toilet paper holders. For example, when the removable insert plates 313, 314 are inserted into the arms 311, 312, the first removable insert plate 313 comprises an interior cradle for receiving a first end of the spindle 315, while the second removable insert plate 314 comprises an interior cradle for receiving a second oppositely disposed end of the spindle 315. As shown in FIG. 16, the toilet tissue roll 306 may be placed on the spindle 315 and supported above the housing 304. As another example, when the removable insert plates 313, 314 are removed from the arms 311, 312, the hanger component 310 is able to accommodate an L-shaped toilet paper holder.

Referring again to FIG. 17, it can be seen that each of the arms 311, 312 of the hanger component 310 comprises a plurality of attachment protrusions 316 (e.g., a pair of attachment protrusions 316) that are configured to snap into corresponding recesses 317 formed in the housing 304 so as to removably attach the hanger component 310 to the housing 304.

Figure 17:
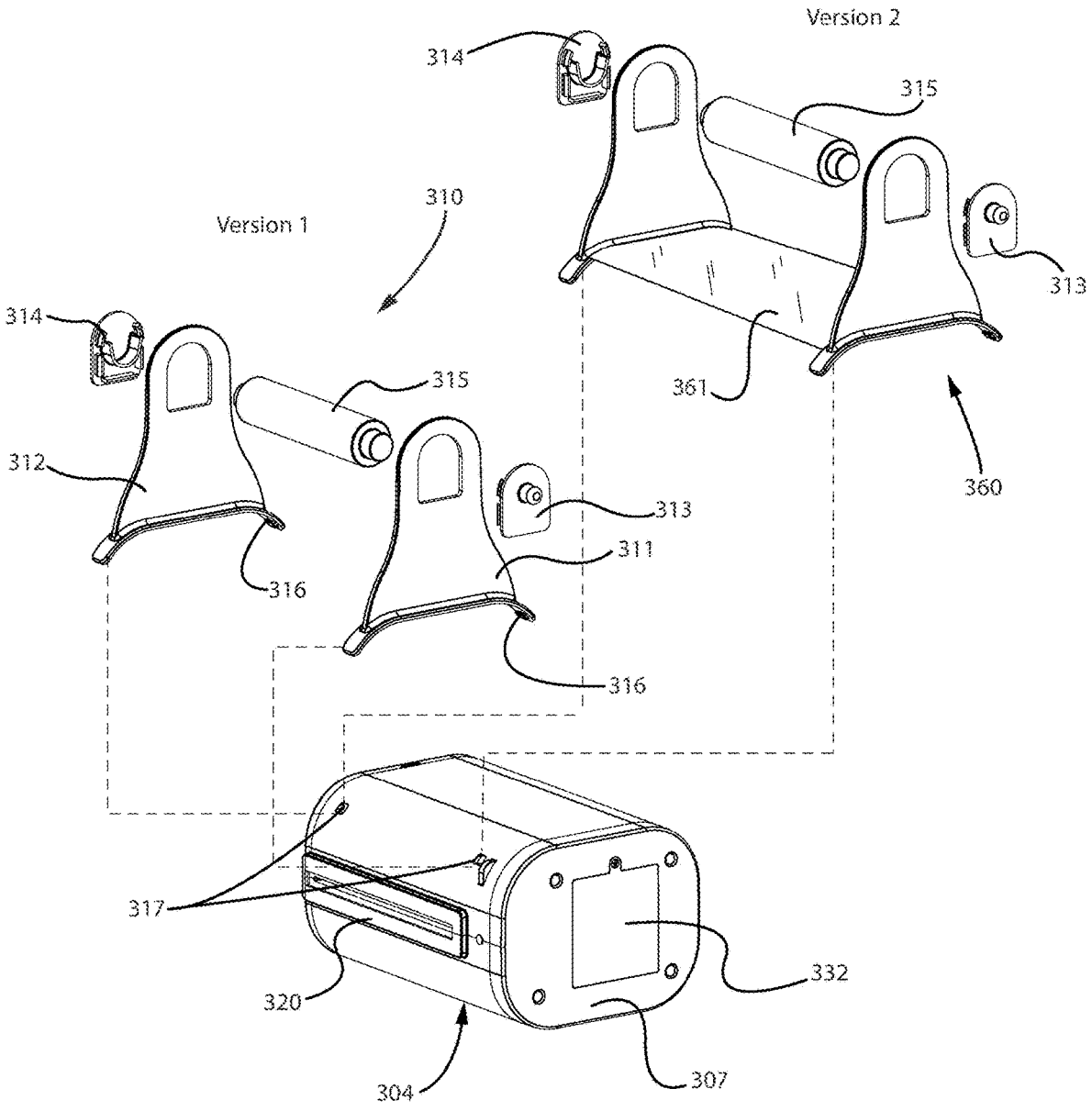
FIG. 17 is a partially exploded view of the dispensing assembly of FIG. 16, where hanger components having two different configurations are shown detached from the remainder of the dispensing assembly.

As shown in FIG. 17, the first version of the hanger component 310 comprises a pair of individual arms 311, 312, while a second version of the hanger component 360 comprises a pair of arms connected to a base plate 361. More particular, as shown in FIG. 17, the pair of arms of the hanger component 360 extend upwardly in a generally perpendicular manner from the base plate 361. Like the arms 311, 312 of the first version of the hanger component 310, the arms of the second version of the hanger component 360 comprise a plurality of attachment protrusions 316 that snap into corresponding recesses 317 formed in the housing 304. As such, the hanger components 310, 360 can be interchangeably used with the housing 304 by snapping and unsnapping the hanger components 310, 360 from the recesses 317.

With reference to FIG. 25, the cartridge 380 comprises a top portion 381 and a bottom portion 382. In the illustrative embodiment, the top portion 381 may be coupled to the bottom portion 382 in a clamshell-type configuration. More particularly, in the illustrative embodiment, the top portion 381 may be coupled to the bottom portion 382 by a hinge 385 extending longitudinally along the elongate rear side of the cartridge 380. The hinge 385 may be integrally formed with the cartridge 380 (i.e., be in the form of a living hinge), or may comprise a strip of thin, flexible material adhered to the cartridge 380 and spanning between the top portion 381 and the bottom portion 382. The top portion 381 of the cartridge 380 may pivot along the hinge 385 to allow access to an interior space of the cartridge 380.

Figure 21:
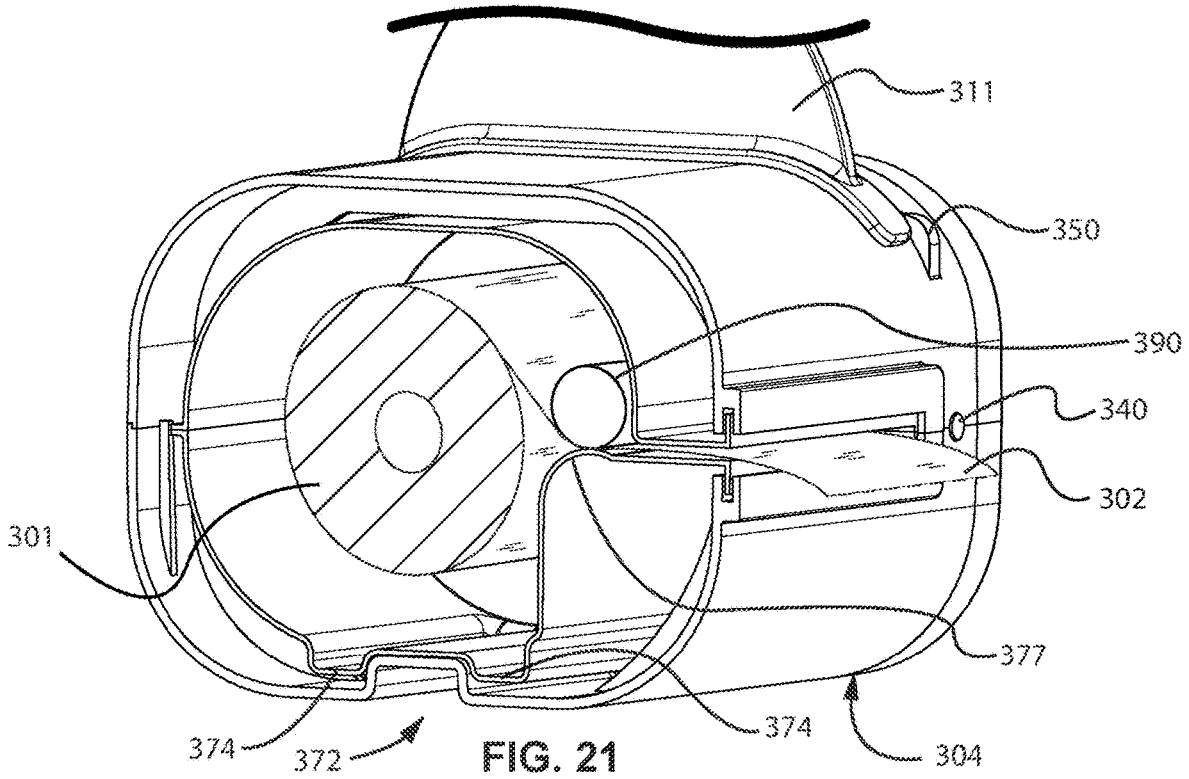
FIG. 21 is a transverse sectional perspective view of the dispensing assembly of FIG. 16.

The cartridge 380 may be for dispensing a paper product 301, as shown in FIGS. 21 and 25. The cartridge 380 may accommodate a variety of wet paper products and may be refillable. The paper product 301 may comprise, for example, a rolled, continuous sheet of a pre-wetted paper product, such as a personal wipe (commonly referred to as a wet wipe or moist towelette), which may be disposable and/or flushable (i.e., may be flushed down a toilet for disposal with other solid waste). Alternatively, the paper product 301 may comprise non-flushable wipes for tabletop use. The paper product 301 may comprise a line of weakness or perforations that define individual sheets. In some embodiments, the cartridge 380 is in the form of a self-contained cartridge where the cartridge 380 completely houses the pre-wetted paper product roll 301. The self-contained cartridge 380 may have the paper product roll 301 preloaded therein as a single use item, or the paper product roll may also be reloaded by the user (i.e., to replace an empty paper product roll 301).

Figure 22:
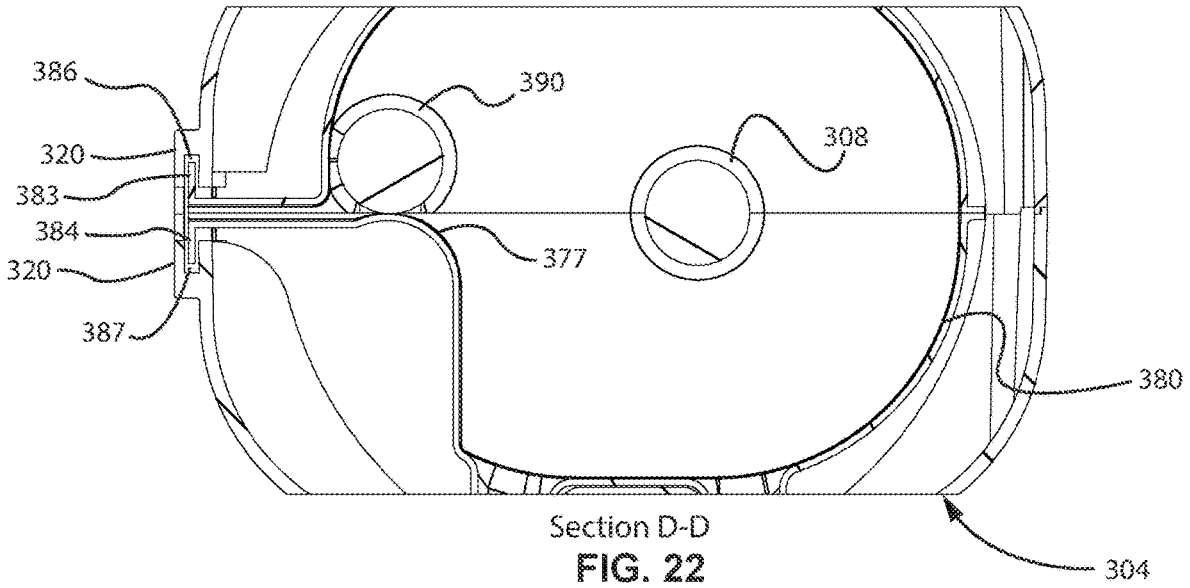
FIG. 22 is a partial transverse sectional view cut through the dispensing assembly of FIG. 16, wherein the section is cut based on the cutting-plane line D-D in FIG. 18.

In the illustrative embodiment, the cartridge 380 comprises an active roller 390 and a curved guide protrusion 377, as shown in FIGS. 21 and 22. The active roller 390 is rotatably coupled to and contained in the top portion 381 of the cartridge 380 (see FIG. 25). The active roller 390 comprises a spur gear recess 394 that engages with a spur gear 391 at one end of the drivetrain. The end of the active roller 390 with the spur gear recess 394 is accessible from the outside of the cartridge 380 by means of an aperture in the end wall of the cartridge 380. The curved guide protrusion 377 is contained in the bottom portion 382 of the cartridge 380. As shown in FIGS. 21 and 22, the active roller 390 is disposed adjacent to the curved guide protrusion 377 when the cartridge 380 is in its closed state.

Also, as shown in FIGS. 23 and 25, the cartridge 380 further comprises a roller core 308 on which the paper product roll 301 is supported. The opposed ends of the roller core 308 are received within opposed semi-circular notches in the top portion 381 of the cartridge 380 and opposed semi-circular notches in the bottom portion 382 of the cartridge 380.

With continued reference to FIG. 25, to install the paper product roll 301 in the cartridge 380, the top portion 381 of the cartridge 380 is opened and the paper product 301 is placed into the cartridge 380 in the direction indicated by the curved arrow 388. A first sheet of the rolled paper product 301 is placed over the curved guide protrusion 377 in the bottom portion 382 and inserted into a slot (see FIG. 21) such that the sheet extends through the slot between the top portion 381 and the bottom portion 382 and extends outward from the front side of the cartridge 380. When the top portion 381 is closed, the active roller 390 contacts the sheet and compresses the paper product 301 between the active roller 390 and curved guide protrusion 377. The active roller 390 may be formed from and/or coated or covered with a nonslip or gripping material. The active roller 390 may also comprise a spring or other structure (not shown) that biases the roller 390 toward the curved guide protrusion 377.

The active roller 390 and the curved guide protrusion 377 together form a seal across the slot through which the paper product 301 is dispensed. This seal may be partially watertight, which helps to reduce loss of moisture from the paper product 301. In addition, the self-contained cartridge 380 fully encloses the paper product 301 on all sides, which further helps to reduce loss of moisture from the paper product 301. Compression of the paper product 301 between the active roller 390 and the curved guide protrusion 377 also helps to prevent retraction or withdrawal of the paper product 301 back through the slot and into the cartridge 380. As described in more detail herein, the active roller 390 and the curved guide protrusion 377 cooperate to dispense sheets (e.g., dispensed sheet 302 in FIG. 21) of the paper product 301 via the cartridge slot and aligned housing slot 326 (see FIG. 16).

As shown in FIGS. 24 and 25, the housing compartment is enclosed on five sides (e.g., by the side, top, and back panels and end cap 307 of the housing 304), with one end of the housing 304 able to be opened by a user. The cartridge 380 may be aligned with the housing compartment and inserted into the housing compartment through the end of the housing 304 with hinged end cap 375. As shown in the illustrative embodiment of FIGS. 23-25, the hinged end cap 375 may have a door hinge member 376 that pivotally couples the end cap 375 to the remainder of the housing 304. Also, as shown in FIGS. 24 and 25, the interior surface of the hinged end cap 375 may include a cartridge standoff 378 for pressing against the end of the cartridge 380 so that it is held tightly in place within the housing 304 without any undesirable sliding.

In the fourth illustrative embodiment, with reference to FIGS. 21, 22, and 24, the housing 304 and the cartridge 380 include a plurality of cooperating alignment elements for facilitating a correct positioning of the cartridge 380 within the housing 304. First of all, as best shown in FIGS. 22 and 24, the plurality of cooperating alignment elements include a protruding flange portion 383, 384 on the front of the cartridge 380 that is configured to engage with a flange slot 386, 387 disposed behind a front bezel 320 of the housing 304. In the illustrative embodiment, the protruding flange portion 383, 384 on the front of the cartridge 380 comprises an upper flange portion 383 and a lower flange portion 384. The upper flange portion 383 is received within an upper portion 386 of the flange slot in the housing 304, and the lower flange portion 384 is received within a lower portion 387 of the flange slot in the housing 304. As the cartridge 380 is slid longitudinally into the housing 304 through the open end of the housing 304, the engagement between the protruding flange portion 383, 384 of the cartridge 380 and the flange slot 386, 387 of the housing 304 maintains the proper alignment of the cartridge 380 in the housing 304. A slight clearance gap is provided between the protruding flange portion 383, 384 of the cartridge 380 and the flange slot 386, 387 of the housing 304 so that the cartridge 380 is able to be easily slid into the housing 304 (see FIG. 22). As shown in FIG. 24, the protruding flange 383, 384 of the cartridge 380 is connected to the main body of the cartridge 380 by a generally horizontal slot extension portion 368. Together the slot extension portion 368 and the protruding flange portion 383, 384 of the cartridge 380 form a duckbill-shaped alignment feature.

Referring again to FIGS. 21 and 24, in the illustrative embodiment, the plurality of cooperating alignment elements further include a pair of spaced-apart elongate protrusions 374 on the bottom of the cartridge 380 that are configured to engage with an elongate protrusion 372 disposed on a floor of the compartment of the housing 304. As the cartridge 380 is slid longitudinally into the housing 304 through the open end of the housing 304, the engagement between the spaced-apart elongate protrusions 374 of the cartridge 380 and the elongate protrusion 372 of the housing 304 also maintains the proper alignment of the cartridge 380 in the housing 304. As shown in FIG. 21, the spaced-apart elongate protrusions 374 of the cartridge 380 are disposed on opposite sides of the elongate protrusion 372 of the housing 304 such that protrusions 372, 374 essentially cooperate to form a sliding track for the cartridge 380. In the illustrative embodiment, the elongate protrusion 372 on the bottom floor of the housing 304 resembles the shape of an upside-down bathtub.

Figure 20:
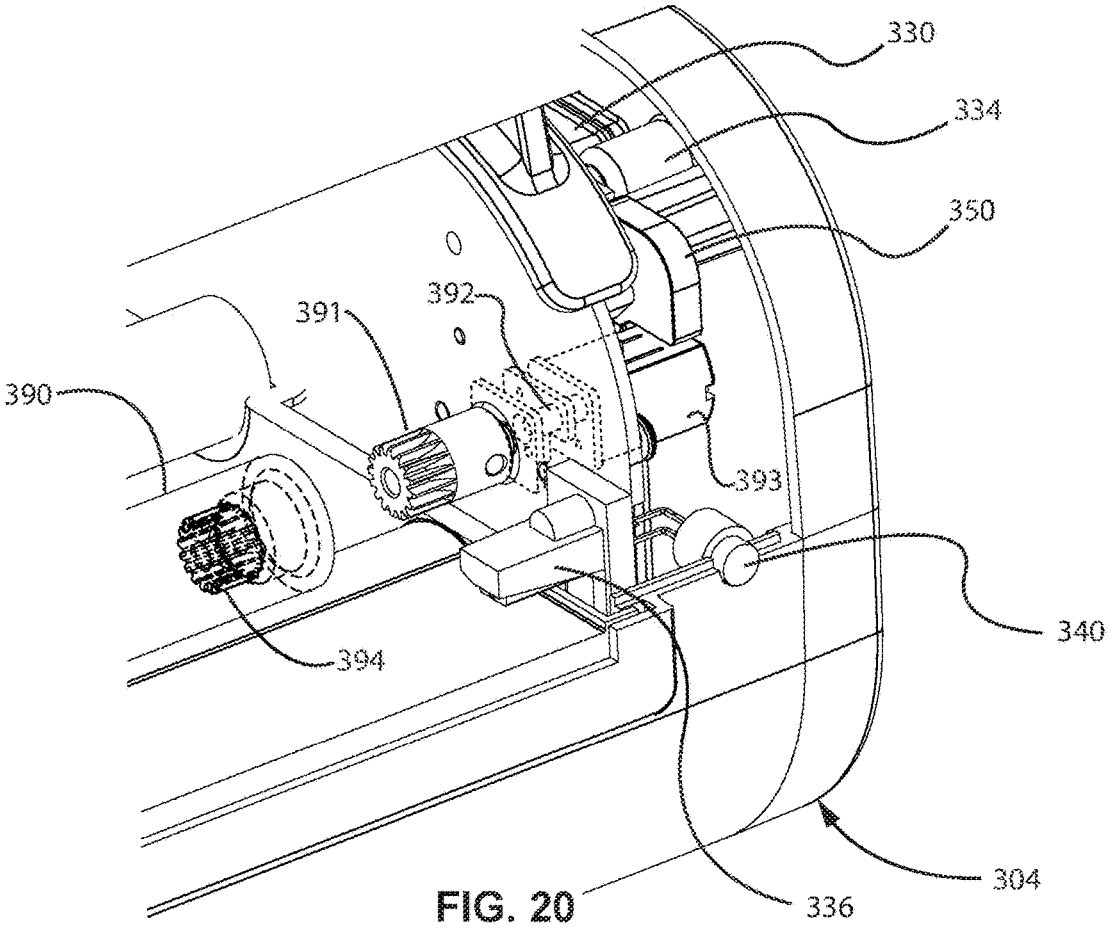
FIG. 20 is a partial cutaway perspective view of the dispensing assembly of FIG. 16, wherein components of the actuation subassembly are illustrated.

Turning to FIG. 20, in the illustrative embodiment, the plurality of cooperating alignment elements further include a self-aligning gear interface. As shown in FIG. 20, the self-aligning gear interface comprises the spur drive gear 391 of the actuation subassembly that is configured to engage with the spur gear recess 394 in the active roller 390 of the cartridge 380. As the cartridge 380 is slid longitudinally into the housing 304 through the open end of the housing 304, the engagement between the spur drive gear 391 of the actuation subassembly and the spur gear recess 394 in the active roller 390 additionally maintains the proper alignment of the cartridge 380 in the housing 304.

With reference to FIG. 20, a portion of the housing 304 adjacent to the housing compartment may further comprise an actuator compartment that encloses the various components of the actuation subassembly 391, 392, 393. The actuator compartment may be defined on four sides by the housing 304, on a fifth side by the housing interior wall, and on a sixth side by the end cap 307. In the illustrative embodiment, the actuator compartment is disposed opposite to the end of the housing with hinged end cap 375. In the illustrative embodiment, the end cap 307 may be provided with a plurality of fastener bosses (e.g., such as the boss 334 depicted in FIG. 20) for accommodating fasteners (e.g., screws) that removably attached the end cap 307 to the remainder of the housing 304. As such, the end cap 307 could be removed by a user when it is necessary to access the components of the actuation subassembly 391, 392, 393.

As shown in FIG. 20, the housing interior wall comprises an opening that accommodates the drive shaft extending therethrough. The opening in the housing interior wall aligns with a central shaft of the drive gear (e.g., spur gear 391). When the cartridge 380 is installed in the housing 304, the spur gear 391 is received within the spur gear recess 394 in the end of the active roller 390.

Now, with reference to FIG. 20, the actuation subassembly 391, 392, 393 of the dispensing assembly 300 will be described in detail. In the fourth embodiment, the actuation subassembly comprises the drive gear 391 (e.g., spur gear 391), a gear box 392, and direct drive motor 393. The drive gear 391 is operatively coupled to the direct drive motor 393 via the gear box 392, which adjusts the rotational output (i.e., the speed and torque) of the direct drive motor 393. In turn, the drive gear 391 is operatively coupled to the active roller 390. When the actuation button 350 (see FIG. 16) is depressed on the front of the housing 304, the drive gear 391 and the active roller 390 rotate a predefined rotational distance to advance the paper product 301. In the illustrative embodiment, the actuation subassembly may further comprise a control board, a microswitch, and an infrared sensor 336 (see FIG. 20) disposed in the housing 304. The microswitch and the infrared sensor 336 are both electrically coupled to the control board.

In the fourth embodiment, the direct drive motor 393 is electrically powered by batteries (e.g., four (4) AA size batteries), which are located in the battery compartment 330 of the housing 304, and are accessible for replacement by means of battery compartment door 332 (see FIG. 17).

In the fourth embodiment, similar to that described above for the second embodiment, the infrared sensor 336 may comprise a photo interrupter arrangement with an infrared wavelength (IR) light emitting diode (LED) and a phototransistor detector positioned face-to-face on an optical axis. The components of the sensor 336 may be positioned such that the dispensed wet wipe product 302 passes between the IR LED and the detector. These components of the sensor 336 may be in a combined package or separate discrete components. When a wipe 302 is positioned between the sensor components of the sensor 336, the transistor is turned "off". When a perforation or line of weakness of the wipe 302 passes between the emitter and detector of the sensor 336, the IR light emitted by the LED reaches the phototransistor and turns the transistor "on". The phototransistor output is connected to the control electronics of the control board to signal that the position of the wipe perforation or line of weakness is near the output opening or slot 326.

Figure 18:
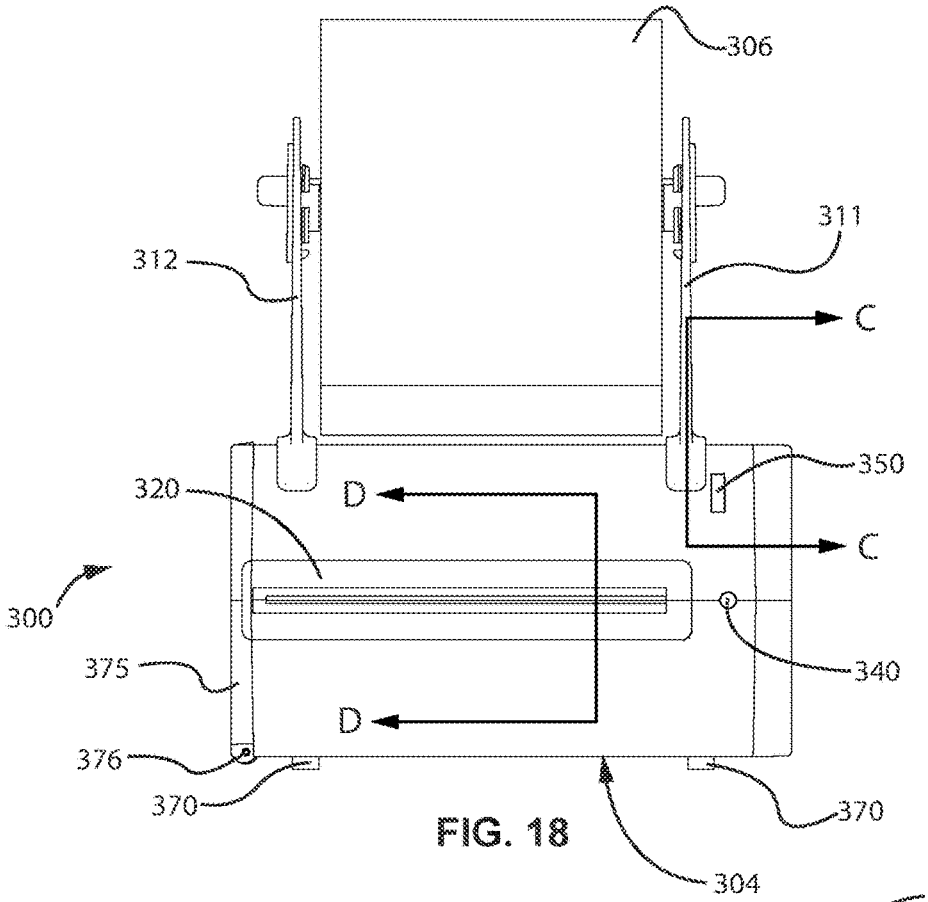
FIG. 18 is a front elevational view of the dispensing assembly of FIG. 16.
Figure 19:
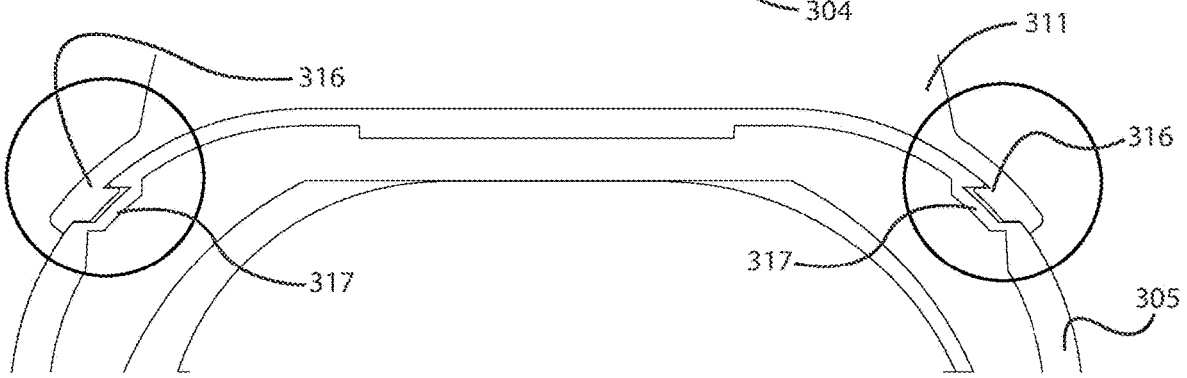
FIG. 19 is a partial transverse sectional view cut through the dispensing assembly of FIG. 16, wherein the section is cut based on the cutting-plane line C-C in FIG. 18.

Similar to that described above for the second embodiment, the electronic control circuit of the control board performs various functions in the fourth embodiment of the dispensing assembly 300. First, the electronic control circuit of the control board results in the dispensing of exactly one pre-moistened wipe 302 from the internal cartridge 380 for each press of the actuation button 350. Secondly, the electronic control circuit of the control board turns off the drive motor 393 at the correct time so that the perforation on the wipe product 302 aligns with the dispensing slot 326. This allows the dispensed product to easily be retrieved by the user by separating the single dispensed wipe from the device. Also, in the illustrative embodiment, the electronic control circuit of the control board in conjunction with the infrared sensor 336 may monitor the amount of paper product remaining in the cartridge 380 and alert the user through a visible or audible warning when the amount of remaining product is considered "low". For example, as shown in FIGS. 16, 18, and 21, the dispensing assembly 300 may comprise a status indicator light 340 disposed on a front of the housing 304. The status indicator light 340 may be configured to be illuminated when an amount of the paper product 301 in the cartridge 380 is determined to be low. Also, the status indicator light 340 may be configured to be illuminated when a power level of the batteries of the actuation subassembly is low. The status indicator light 340 may be illuminated with a first color (e.g., red) for a low battery and a second color (e.g., yellow) for a low paper roll. In the illustrative embodiment, the electronic control circuit may be implemented using commercially available electronics components on a custom printed circuit board (PCB). The circuit design utilizes common analog and digital design techniques. Logic control may be achieved using a microcontroller with custom software, digital logic timer/counter integrated circuits, or a combination of these.

In the fourth embodiment, when a user presses the actuation button 350 with his or her finger on the front of the housing 304 (see FIG. 16), the microswitch is in turn depressed by the actuation button 350, and a control signal is sent to the control board. Upon the actuation of the microswitch, the control circuit in the control board turns the drive motor 393 on and also starts a timer. The timer's expiration time is pre-programmed to be longer than the typical time required to dispense a single wet wipe. If the photo interrupter does not detect the wipe perforation or line of weakness, the drive motor 393 will run for this predetermined time and then stop. This prevents inadvertent dispensing of the entire roll 301 in the event of a sensing failure. When the perforation or line of weakness is detected by the photo interrupter, the first timer is canceled. A second timer is started. Expiry of this second timer stops the drive motor 393. The run time of the second timer is configured to allow the wipe perforation to pass fully beyond the active roller 390 and the output slot 326 in the housing 304. The additional motor drive time controlled by the second timer: (a) ensures that the perforation or line of weakness is out far enough to facilitate easy removal of the wipe and (b) prevents the next wipe from losing contact with the drive roller 390.

When the drive motor 393 is activated by the control circuit in the control board, the drive motor 393 rotates the gear box components 392, which in turn, rotates the drive gear 391. Rotation of the drive gear 391 causes the active roller 390 to rotate a corresponding rotational distance. This rotation of the active roller 390 causes the sheet of the rolled or stacked paper product 301 extending from the slot 326 to move outwardly from the housing 304. In this manner, sheets of the paper product 301 are dispensed one at a time from the cartridge 380. Compression of the paper product 301 between the active roller 390 and the curved guide protrusion 377 keeps the paper product 301 from retracting back into the cartridge 380 between depressions of the actuation button 350. Upon depletion of the paper product 301, the cartridge 380 may be removed from the housing 304 as described herein for refilling or disposal (see FIG. 24)

With reference to the bottom perspective view of FIG. 23, it can be seen that, in the illustrative embodiment, the dispensing assembly 300 may be provided with a plurality of support feet 370 (e.g., four (4) polymeric pads) in each corner on the bottom of the housing 304 for allowing the dispensing assembly 300 to rest on a tabletop or other horizontal surface.

Dispensing assemblies in accordance with the present disclosure provide a number of advantages over known combination dispensers. For example, attachment of the dispensing assembly to a fixed substrate such as a wall-mounted, toilet tissue holder places the personal wipes within easy reach for use in combination with dry paper products such as a conventional toilet tissue roll. There is generally no need to install an additional or specific holder, especially for the dispensing assembly, as the housing can typically be installed on an existing holder. There is also generally no need to modify the existing holder, the wall, or any other adjacent structure to accommodate the dispensing assembly. The compact housing hangs below the fixed substrate to take advantage of unused space, while allowing unencumbered access to the dry paper products positioned above the compartment that receives the cartridge. The cartridge may accommodate a variety of different rolled and stacked wet paper products and provides for easy installation and removal by a consumer. The cartridge helps to prevent moisture loss in the case of a pre-wetted paper product by enclosure of the paper product on all sides and formation of a seal between the active and passive rollers near the slot from which the paper product is dispensed. The cartridge may be reusable and/or refillable, and the housing and cartridge may be recycled at the end of their life cycles.

Any of the features or attributes of the above-described embodiments and variations can be used in combination with any of the other features and attributes of the above-described embodiments and variations as desired.

Having thus described the invention of the present application in detail and by reference to embodiments thereof, it will be apparent that modifications and variations are possible without departing from the scope of the invention defined in the appended claims.

The invention claimed is:

1. A dispensing assembly, comprising:

a housing;

a cartridge configured to dispense a paper product, the cartridge being removably received in the housing; and a hanger component attached to the housing comprising at least one arm that suspends the housing below a spindle.

2. The dispensing assembly according to claim 1, wherein the housing comprises a plurality of side panels that together define a compartment.

3. The dispensing assembly according to claim 2, wherein the cartridge is configured to be inserted into an end of the housing.

4. The dispensing assembly according to claim 3, wherein the housing further comprises an elongate body portion with the plurality of side panels and a pair of end caps for attaching to opposed ends of the elongate body portion, wherein one of the end caps is hingedly connected to the elongate body portion of the housing for accessing the compartment that removably receives the cartridge.

5. The dispensing assembly according to claim 1, further including an actuation subassembly associated with the housing; the actuation subassembly being configured to advance the paper product from the cartridge.

6. The dispensing assembly according to claim 5, wherein the housing and or cartridge include one or more alignment elements for facilitating a correct positioning of the cartridge within the housing, wherein the one or more alignment elements further include a self-aligning gear interface, the self-aligning gear interface comprising a drive gear of the actuation subassembly that is configured to engage with a gear recess in an active roller of the cartridge.

7. The dispensing assembly according to claim 5, wherein the actuation subassembly comprises a drive gear and a drive motor, the drive gear being operatively coupled to the drive motor and to an active roller, and when a button is depressed on the housing, the drive gear and the active roller rotate a predefined rotational distance to advance the paper product.

8. The dispensing assembly according to claim 5, further comprising a status indicator light disposed on a front of the housing, the status indicator light configured to be illuminated when a power level of a battery of the actuation subassembly is low and/or when an amount of the paper product in the cartridge is determined to be low.

9. The dispensing assembly according to claim 1, wherein the housing and or cartridge include one or more alignment elements for facilitating a correct positioning of the cartridge within the housing.

10. The dispensing assembly according to claim 9, wherein the one or more alignment elements include a protruding flange portion on a front of the cartridge that is configured to engage with a flange slot disposed behind a front surface of the housing.

11. The dispensing assembly according to claim 9, wherein the one or more alignment elements further include a pair of spaced-apart protrusions on a bottom of the cartridge that are configured to engage with a protrusion disposed on a floor of the compartment of the housing.

12. The dispensing assembly according to claim 1, wherein the cartridge further comprises a top portion and a bottom portion, the top portion of the cartridge being hingedly connected to the bottom portion, the top portion comprising an active roller and the bottom portion comprising a curved protrusion; and when the top portion is closed against the bottom portion, the active roller is adjacent to the curved protrusion and the paper product is compressed between the active roller and the curved protrusion.

13. The dispensing assembly according to claim 1, wherein the hanger component comprises a plurality of attachment protrusions that are configured to snap into corresponding recesses formed in the housing so as to removably attach the hanger component to the housing.

14. The dispensing assembly according to claim 1, wherein at least one of the arms of the hanger component comprises a removable insert plate for allowing the hanger component to accommodate different configurations of toilet paper holders.

15. The dispensing assembly according to claim 1, wherein the paper product comprises cleaning wipes disposed on a roll.

16. A dispensing assembly, comprising:

a housing; and a cartridge configured to dispense a paper product, the cartridge being removably received in the housing, wherein the cartridge comprises an active roller and a curved protrusion; and when the active roller is closed against the curved protrusion, the paper product is compressed between the active roller and the curved protrusion.

17. The dispensing assembly according to claim 16, further comprising an actuation subassembly being disposed in the housing, the actuation subassembly configured to advance the paper product disposed in the cartridge, wherein the actuation subassembly comprises a drive gear and a drive motor, the drive gear being operatively coupled to the drive motor and to the active roller, and when a button is depressed on the housing, the drive gear and the active roller rotate a predefined rotational distance to advance the paper product.

18. The dispensing assembly according to claim 16, wherein the housing and/or the cartridge include one or more alignment elements for facilitating a correct positioning of the cartridge within the housing.

19. The dispensing assembly according to claim 18, wherein the one or more alignment elements include a self-aligning gear interface, a drive gear of the actuation subassembly being configured to engage with a gear recess in the active roller of the cartridge so as to form the self-aligning gear interface.

20. The dispensing assembly according to claim 16, further comprising a hanger component attached to the housing, the hanger component comprising a pair of arms that suspend the housing below a spindle.

* * * * *